US010771910B2

(12) United States Patent
Oh et al.

(10) Patent No.: US 10,771,910 B2
(45) **Date of Patent: *Sep. 8, 2020**

(54) AUDIO SIGNAL PROCESSING METHOD AND APPARATUS

(71) Applicant: WILUS INSTITUTE OF STANDARDS AND TECHNOLOGY INC., Gyeonggi-do (KR)

(72) Inventors: Hyunoh Oh, Gyeonggi-do (KR); Taegyu Lee, Gyeonggi-do (KR); Jinsam Kwak, Gyeonggi-do (KR); Juhyung Son, Gyeonggi-do (KR)

(73) Assignee: WILUS INSTITUTE OF STANDARDS AND TECHNOLOGY INC., Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/395,242

(22) Filed: Apr. 26, 2019

(65) Prior Publication Data

US 2019/0253822 A1 Aug. 15, 2019

Related U.S. Application Data

(63) Continuation of application No. 16/105,945, filed on Aug. 20, 2018, now Pat. No. 10,321,254, which is a (Continued)

(30) Foreign Application Priority Data

Mar. 24, 2014 (KR) ..... 10-2014-0033966

(51) Int. Cl.
*H04S 3/00* (2006.01)
*G10L 19/20* (2013.01)

(52) U.S. Cl.
CPC ..... *H04S 3/008* (2013.01); *G10L 19/20* (2013.01); *H04S 2400/01* (2013.01); (Continued)

(58) Field of Classification Search
CPC .. H04S 3/008; H04S 2400/01; H04S 2400/11; H04S 2420/07; H04S 2400/03; H04S 2420/01; G10L 19/20
(Continued)

(56) References Cited

U.S. PATENT DOCUMENTS 5,329,587 A 7/1994 Morgan et al.
5,371,799 A 12/1994 Lowe et al.
(Continued)

FOREIGN PATENT DOCUMENTS

EP 0 700 155 3/1996
EP 2 530 840 12/2012
(Continued)

OTHER PUBLICATIONS

International Preliminary Report on Patentability (Chapter I) for PCT/KR2014/008677 dated Mar. 31, 2016 and its English translation from WIPO.
(Continued)

*Primary Examiner* — Melur Ramakrishnaiah
(74) *Attorney, Agent, or Firm* — Ladas & Parry, LLP

(57) ABSTRACT

The present invention relates to a method and an apparatus for processing an audio signal, and more particularly, to a method and an apparatus for processing an audio signal, which synthesize an object signal and a channel signal and effectively perform binaural rendering of the synthesized signal.

To this end, provided are a method for processing an audio signal, which includes: receiving an input audio signal including a multi-channel signal; receiving truncated sub-
(Continued)

band filter coefficients for filtering the input audio signal, the truncated subband filter coefficients being at least some of subband filter coefficients obtained from binaural room impulse response (BRIR) filter coefficients for binaural filtering of the input audio signal and the length of the truncated subband filter coefficients being determined based on filter order information obtained by at least partially using reverberation time information extracted from the corresponding subband filter coefficients; obtaining vector information indicating the BRIR filter coefficients corresponding to each channel of the input audio signal; and filtering each subband signal of the multi-channel signal by using the truncated subband filter coefficients corresponding to the relevant channel and subband based on the vector information and an apparatus for processing an audio signal by using the same.

10 Claims, 14 Drawing Sheets

Related U.S. Application Data continuation of application No. 15/795,180, filed on Oct. 26, 2017, now Pat. No. 10,070,241, which is a continuation of application No. 15/124,029, filed as application No. PCT/KR2015/002669 on Mar. 19, 2015, now Pat. No. 9,832,585.

(60) Provisional application No. 61/955,243, filed on Mar. 19, 2014.

(52) U.S. Cl.
CPC ..... *H04S 2400/03* (2013.01); *H04S 2400/11* (2013.01); *H04S 2420/01* (2013.01); *H04S 2420/07* (2013.01)

(58) Field of Classification Search
USPC ..... 381/1, 17–22; 704/500
See application file for complete search history.

(56) References Cited

U.S. PATENT DOCUMENTS

| | | | |
|---|---|---|---|
| 5,544,249 | A | 8/1996 | Opitz |
| 5,757,931 | A | 5/1998 | Yamada et al. |
| 6,108,626 | A | 8/2000 | Cellario et al. |
| 7,715,575 | B1 | 5/2010 | Sakurai et al. |
| 8,265,284 | B2 | 9/2012 | Villemoes et al. |
| 8,515,104 | B2 | 8/2013 | Dickins et al. |
| 8,788,554 | B2 | 7/2014 | Christoph |
| 9,319,794 | B2 | 4/2016 | Betlehem et al. |
| 9,432,790 | B2 | 8/2016 | Raghuvanshi et al. |
| 9,578,437 | B2 | 2/2017 | Oh et al. |
| 9,584,943 | B2 | 2/2017 | Oh et al. |
| 9,832,585 | B2 | 11/2017 | Oh et al. |
| 9,832,589 | B2 | 11/2017 | Lee et al. |
| 9,860,668 | B2 | 1/2018 | Oh et al. |
| 9,961,469 | B2 | 5/2018 | Lee et al. |
| 2005/0117762 | A1 | 6/2005 | Sakurai et al. |
| 2007/0071249 | A1 | 3/2007 | Reining et al. |
| 2007/0100612 | A1 | 5/2007 | Ekstrand et al. |
| 2007/0172086 | A1 | 7/2007 | Dickins et al. |
| 2008/0008342 | A1 | 1/2008 | Sauk |
| 2008/0025519 | A1 | 1/2008 | Yu et al. |
| 2008/0033730 | A1 | 2/2008 | Jot et al. |
| 2008/0192941 | A1 | 8/2008 | Oh et al. |
| 2008/0205658 | A1 | 8/2008 | Breebaart |
| 2008/0253578 | A1 | 10/2008 | Breebaart et al. |
| 2009/0012638 | A1 | 1/2009 | Lou |
| 2009/0041263 | A1 | 2/2009 | Hoshuyama |
| 2009/0043591 | A1 | 2/2009 | Breebaart et al. |
| 2009/0048847 | A1 | 2/2009 | Jung et al. |
| 2009/0103738 | A1 | 4/2009 | Faure et al. |
| 2009/0225991 | A1* | 9/2009 | Oh ..... H04S 1/007 381/17 |
| 2009/0252356 | A1 | 10/2009 | Goodwin et al. |
| 2009/0319283 | A1 | 12/2009 | Schnell et al. |
| 2010/0017195 | A1 | 1/2010 | Villemoes |
| 2010/0080112 | A1 | 4/2010 | Bertrand et al. |
| 2010/0169104 | A1 | 7/2010 | Ekstrand et al. |
| 2010/0246832 | A1* | 9/2010 | Villemoes ..... G10L 19/008 381/17 |
| 2010/0246851 | A1 | 9/2010 | Buck et al. |
| 2010/0322431 | A1 | 12/2010 | Lokki et al. |
| 2011/0170721 | A1 | 7/2011 | Dickins et al. |
| 2011/0211702 | A1 | 9/2011 | Mundt et al. |
| 2011/0261948 | A1 | 10/2011 | Deng et al. |
| 2011/0264456 | A1* | 10/2011 | Koppens ..... G10L 19/008 704/500 |
| 2011/0305345 | A1 | 12/2011 | Bouchard et al. |
| 2012/0014528 | A1 | 1/2012 | Wang |
| 2012/0039477 | A1 | 2/2012 | Schijers et al. |
| 2012/0243713 | A1 | 9/2012 | Hess |
| 2013/0028427 | A1 | 1/2013 | Yamamoto et al. |
| 2013/0090933 | A1 | 4/2013 | Villemoes et al. |
| 2013/0182870 | A1 | 7/2013 | Villemoes |
| 2013/0208902 | A1 | 8/2013 | Yamamoto et al. |
| 2013/0272526 | A1 | 10/2013 | Walther |
| 2013/0272527 | A1 | 10/2013 | Oomen et al. |
| 2014/0006037 | A1 | 1/2014 | Honma et al. |
| 2014/0088978 | A1 | 3/2014 | Mundt et al. |
| 2014/0270189 | A1* | 9/2014 | Atkins ..... H04S 3/00 381/17 |
| 2014/0355796 | A1 | 12/2014 | Xiang et al. |
| 2015/0030160 | A1 | 1/2015 | Lee et al. |
| 2015/0223002 | A1 | 8/2015 | Mehta et al. |
| 2015/0358754 | A1* | 12/2015 | Koppens ..... H04S 1/005 381/17 |
| 2016/0189723 | A1 | 6/2016 | Davis |
| 2016/0198281 | A1 | 7/2016 | Oh et al. |
| 2016/0219388 | A1 | 7/2016 | Oh et al. |
| 2016/0249149 | A1 | 8/2016 | Oh et al. |
| 2016/0275956 | A1 | 9/2016 | Lee et al. |
| 2016/0277865 | A1 | 9/2016 | Lee et al. |
| 2016/0323688 | A1 | 11/2016 | Lee et al. |
| 2017/0019746 | A1 | 1/2017 | Oh et al. |
| 2018/0048975 | A1 | 2/2018 | Oh et al. |
| 2018/0359587 | A1 | 12/2018 | Oh et al. |

FOREIGN PATENT DOCUMENTS

| | | |
|---|---|---|
| EP | 2 541 542 | 1/2013 |
| EP | 2 840 811 | 2/2015 |
| EP | 3 048 814 | 7/2016 |
| JP | 2009-531906 | 9/2009 |
| JP | 2009-261022 | 11/2009 |
| JP | 5084264 | 11/2012 |
| KR | 10-2005-0123396 | 12/2005 |
| KR | 10-0754220 | 9/2007 |
| KR | 10-2008-0076691 | 8/2008 |
| KR | 10-2008-0078882 | 8/2008 |
| KR | 10-2008-0098307 | 11/2008 |
| KR | 10-2008-0107422 | 12/2008 |
| KR | 10-2009-0020813 | 2/2009 |
| KR | 10-2009-0047341 | 5/2009 |
| KR | 10-0924576 | 11/2009 |
| KR | 10-2010-0062784 | 6/2010 |
| KR | 10-2010-0063113 | 6/2010 |
| KR | 10-0971700 | 7/2010 |
| KR | 10-2011-0002491 | 1/2011 |
| KR | 10-2012-0006060 | 1/2012 |
| KR | 10-2012-0013893 | 2/2012 |
| KR | 10-1146841 | 5/2012 |
| KR | 10-2013-0045414 | 5/2013 |
| KR | 10-2013-0081290 | 7/2013 |
| KR | 10-1304797 | 9/2013 |
| KR | 10-1833059 | 2/2018 |
| WO | 2008/003467 | 1/2008 |

(56) References Cited

FOREIGN PATENT DOCUMENTS

| | | |
|---|---|---|
| WO | 2009/046223 | 4/2009 |
| WO | 2011/115430 | 9/2011 |
| WO | 2012/023864 | 2/2012 |
| WO | 2015/041476 | 3/2015 |

OTHER PUBLICATIONS

Written Opinion of the International Searching Authority for PCT/KR2014/008677 dated Jan. 23, 2015 and its English translation from WIPO.
International Search Report for PCT/KR2014/008677 dated Jan. 23, 2015 and its English translation from WIPO.
International Preliminary Report on Patentability (Chapter I) for PCT/KR2014/008678 dated Mar. 31, 2016 and its English translation from WIPO.
Written Opinion of the International Searching Authority for PCT/KR2014/008678 dated Jan. 23, 2015 and its English translation from WIPO.
International Search Report for PCT/KR2014/008678 dated Jan. 23, 2015 and its English translation from WIPO.
International Preliminary Report on Patentability (Chapter I) for PCT/KR2014/008679 dated Mar. 31, 2016 and its English translation from WIPO.
Written Opinion of the International Searching Authority for PCT/KR2014/008679 dated Jan. 26, 2015 and its English translation from WIPO.
International Search Report for PCT/KR2014/008679 dated Jan. 26, 2015 and its English translation from WIPO.
International Preliminary Report on Patentability (Chapter I) for PCT/KR2014/009975 dated May 6, 2016 and its English translation from WIPO.
Written Opinion of the International Searching Authority for PCT/KR2014/009975 dated Jan. 26, 2015 and its English translation from WIPO.
International Search Report for PCT/KR2014/009975 dated Jan. 26, 2015 and its English translation from WIPO.
International Preliminary Report on Patentability (Chapter I) for PCT/KR2014/009978 dated May 6, 2016 and its English translation from WIPO.
Written Opinion of the International Searching Authority for PCT/KR2014/009978 dated Jan. 20, 2015 and its English translation from WIPO.
International Search Report for PCT/KR2014/009978 dated Jan. 20, 2015 and its English translation from WIPO.
International Preliminary Report on Patentability (Chapter I) for PCT/KR2014/012758 dated Jul. 7, 2016 and its English translation from WIPO.
Written Opinion of the International Searching Authority for PCT/KR2014/012758 dated Apr. 10, 2015 and its English machine translation by Google Translate.
International Search Report for PCT/KR2014/012758 dated Apr. 13, 2015 and its English translation from WIPO.
International Preliminary Report on Patentability (Chapter I) for PCT/KR2014/012764 dated Jul. 7, 2016 and its English translation from WIPO.
Written Opinion of the International Searching Authority for PCT/KR2014/012764 dated Apr. 13, 2015 and its English translation from WIPO.
International Search Report for PCT/KR2014/012764 dated Apr. 13, 2015 and its English translation from WIPO.
International Preliminary Report on Patentability (Chapter I) for PCT/KR2014/012766 dated Jul. 7, 2016 and its English translation from WIPO.
Written Opinion of the International Searching Authority for PCT/KR2014/012766 dated Apr. 13, 2015 and its English translation from WIPO.
International Search Report for PCT/KR2014/012766 dated Apr. 13, 2015 and its English translation from WIPO.
Written Opinion of the International Searching Authority for PCT/KR2015/002669 dated Jun. 5, 2015 and its English translation provided by Applicant's foreign counsel.
International Search Report for PCT/KR2015/002669 dated Jun. 5, 2015 and its English translation from WIPO.
Written Opinion of the International Searching Authority for PCT/KR2015/003328 dated Jun. 22, 2015 and its English translation provided by Applicant's foreign counsel.
International Search Report for PCT/KR2015/003328 dated Jun. 22, 2015 and its English translation from WIPO.
Written Opinion of the International Searching Authority for PCT/KR2015/003330 dated Jun. 5, 2015 and its English translation provided by Applicant's foreign counsel.
International Search Report for PCT/KR2015/003330 dated Jun. 5, 2015 and its English translation from WIPO.
Astik Biswas et al., "Admissible wavelet packet features based on human inner ear frequency response for Hindi consonant recognition", Computers & Electrical Engineering, Feb. 22, 2014, p. 1111-1122.
Jeroen Breebaart et al., "Binaural Rendering in MPEG Surround", EURASIP Journal on advances in signal processing, Jan. 2, 2008, vol. 2008, No. 7, pp. 1-14
Office Action dated Apr. 6, 2016 for Korean Patent Application No. 10-2016-7001431 and its English translation provided by Applicant's foreign counsel.
Office Action dated Apr. 12, 2016 for Korean Patent Application No. 10-2016-7001432 and its English translation provided by Applicant's foreign counsel.
Non-Final Office Action dated Jun. 13, 2016 for U.S. Appl. No. 14/990,814 (now published as U.S. 2016/0198281).
Non-Final Office Action dated Jun. 13, 2016 for U.S. Appl. No. 15/145,822 (now published as U.S. 2016-0249149).
Notice of Allowance dated Aug. 28, 2017 for U.S. Appl. No. 15/300,277 (now published as U.S. 2017/0188175).
Extended European Search Report dated Sep. 15, 2017 for EP Patent Application No. 15764805.6.
Final Office Action dated Aug. 23, 2017 for U.S. Appl. No. 15/022,922 (now published as U.S. 2016/0234620).
Office Action dated Jun. 5, 2017 for Korean Patent Application No. 10-2016-7016590 and its English translation provided by Applicant's foreign council.
Extended European Search Report dated Jun. 1, 2017 for European Patent Application No. 14856742.3.
Extended European Search Report dated Jun. 1, 2017 for European Patent Application No. 14855415.7.
Extended European Search Report dated Jul. 27, 2017 for European Patent Application No. 14875534.1.
"Information technology—MPEG audio technologies—part 1: MPEG Surround", ISO/IEC 23003-1:2007, IEC, 3, Rue De Varembe, PO Box 131, CH-1211 Geneva 20, Switzerland, Jan. 29, 2007 (Jan. 29, 2007), pp. 1-280, XPO82000863, pp. 245, 249.
David Viret et al.: "Description of France Telecom Binaural Decoding proposal for MPEG Surround", 76, MPEG Meeting, Mar. 4, 2006-Jul. 4, 2006; Montreux; (Motion Picture Expert Group or ISO/IEC JTC1/SC29/WG11), No. M13276, 30.
Torres J C B et al.: "Low-order modeling of head-related transfer functions using wavelet transforms", Proceedings/2004 IEEE International Symposium on Circuits and Systems: May 23-26, 2004, Sheraton Vancouver Wall.
ISO/IEC FDIS 23003-1:2006(E). Information technology—MPEG audio technologies Part 1: MPEG Surround. ISO/IEC JTC 1/SC 29/WG 11. Jul. 21, 2006, pp. 1-283.
Emerit Marc et al: "Efficient Binaural Filtering in QMF Domain for BRIR", AES Convention 122; May 2007, AES, 60 East 42$^{nd}$ Street, Room 2520, New York 10165-2520, USA, May 1, 2007 (May 1, 2007), XP040508167 the whole document.
Smith, Julious Orion. "Physical Audio Signal Processing: for virtual musical instruments and audio effects." pp. 1-3, 2006.
Office Action dated Mar. 20, 2017 for Korean Patent Application No. 10-2016-7006858 and its English translation provided by Applicant's foreign counsel.

(56) References Cited

OTHER PUBLICATIONS

Office Action dated Mar. 20, 2017 for Korean Patent Application No. 10-2016-7006859 and its English translation provided by Applicant's foreign counsel.
Office Action dated Mar. 20, 2017 for Korean Patent Application No. 10- 2016-7009852 and its English translation provided by Applicant's foreign counsel.
Office Action dated Mar. 20, 2017 for Korean Patent Application No. 10- 2016-7009853 and its English translation provided by Applicant's foreign counsel.
Non-Final Office Action dated Mar. 22, 2017 for U.S. Appl. No. 15/022,923 (now published as U.S. 2016/0219388).
Non-Final Office Action dated Feb. 21, 2017 for U.S. Appl. No. 15/022,922 (now published as U.S. 2016/0234620).
Notice of Allowance dated Jul. 19, 2017 for U.S. Appl. No. 15/107,462 (now published as U.S. 2016/0323688).
Non-Final Office Action dated Mar. 16, 2017 for U.S. Appl. No. 15/107,462 (now published as U.S. 2016/0323688).
Extended European Search Report dated Apr. 28, 2017 for European Patent Application No. 14846160.1.
Extended European Search Report dated Apr. 28, 2017 for European Patent Application No. 14845972.0.
Extended European Search Report dated Apr. 28, 2017 for European Patent Application No. 14846500.8.
Notice of Allowance dated May 5, 2017 for U.S. Appl. No. 15/124,029 (now published as US 2017/0019746).
Non-Final Office Action dated Apr. 5, 2018 for U.S. Appl. No. 15/031,275 (now published as U.S. 2016/0277865).
Non-Final Office Action dated Jun. 15, 2018 for U.S. Appl. No. 15/022,923 (now published as U.S. 2016/0219388).
Advisory Office Action dated Apr. 25, 2018 for U.S. Appl. No. 15/022,923 (now published as U.S. 2016/0219388).
Final Office Action dated May 7, 2018 for U.S. Appl. No. 15/031,274 (now published as U.S. 2016/0275956).
Notice of Allowance dated May 9, 2018 for Chinese Application No. 201580018973.0 and its English translation provided by Applicant's foreign council.
Office Action dated Jun. 15, 2018 for Canadian Application No. 2,934,856.
Notice of Allowance dated May 3, 2018 for U.S. Appl. No. 15/795,180 (now published as US 2018-0048975).
Notice of Allowance dated Jul. 9, 2018 for U.S. Appl. No. 15/795,180 (now published as US 2018-0048975).
Notice of Allowance dated Oct. 11, 2016 for U.S. Appl. No. 14/990,814 (now published as U.S. 2016/0198281).
Notice of Allowance dated Oct. 24, 2017 for U.S. Appl. No. 15/022,922 (now published as U.S. 2016-0234620).
Notice of Allowance dated Sep. 15, 2017 for U.S. Appl. No. 15/107,462 (now published as U.S. 2016-0323688).
Notice of Allowance dated Oct. 24, 2017 for U.S. Appl. No. 15/107,462 (now published as U.S. 2016-0323688).
Notice of Allowance dated Jan. 4, 2017 for U.S. Appl. No. 15/145,822 (now published as U.S. 2016-0249149).
Non-Final Office Action dated Jan. 24, 2019 for U.S. Appl. No. 15/942,588.
Final Office Action dated Feb. 7, 2019 for U.S. Appl. No. 15/022,923.
Office Action dated Jan. 16, 2019 for Canadian Patent Application No. 2,924,458.
Office Action dated Feb. 7, 2019 for European Patent Application No. 14 855 415.7.
Notice of Allowance dated Feb. 8, 2019 for European Patent Application No. 14 856 742.3.
Notice of Allowance dated Jan. 25, 2019 U.S. Appl. No. 16/105,945 (now published as U.S. 2018-0359587).
Office Action dated Feb. 18, 2020 for European Patent Application No. 15764805.6.
Jeongil Seo et al.: "Technical Description of ETRI/Yonsei/WILUS Binaural CE Proposal in MPEG-H 3D Audio", 107. MPEG Meeting; Jan. 13, 2014-Jan. 17, 2014; San Jose (Motion Picture Expert Group or ISO/IEC JTC1/SC29/WG11), No. m32223, Jan. 8, 2014 (Jan. 8, 2014), XP030060675.
Marc Emerit et al.: "Thoughts on Binaural Decoder Parameterization", 106. MPEG Meeting: Oct. 28, 2013-Jan. 11, 2013; Geneva; (Motion Picture Expert Group or ISO/IEC JTC1/SC29/WG11). No. m31427, Oct. 23, 2013 (Oct. 23, 2013), XP030059879.
Preliminary Office Action dated Mar. 9, 2020 for Brazilian Application No. BR112016005956-5 and its English translation provided by Applicant's foreign counsel.
Preliminary Office Action dated Mar. 31, 2020 for Brazilian Application No. BR112016014892-4 and its English translation provided by Applicant's foreign counsel.
Notice of Allowance dated Jun. 9, 2020 for Korean Patent Application No. 10-2018-7005180 and its English machine translation by Google Translate.

* cited by examiner

AUDIO SIGNAL PROCESSING METHOD AND APPARATUS

CROSS-REFERENCE TO RELATED APPLICATIONS

This application claims priority to and the benefit of U.S. Provisional Application No. 61/955,243 filed in the United States Patent and Trademark Office on Mar. 19, 2014, and Korean Patent Application No. 10-2014-0033966 filed in the Korean Intellectual Property Office on Mar. 24, 2014, the entire contents of which are incorporated herein by reference.

TECHNICAL FIELD

The present invention relates to a method and an apparatus for processing an audio signal, and more particularly, to a method and an apparatus for processing an audio signal, which synthesize an object signal and a channel signal and effectively perform binaural rendering of the synthesized signal.

BACKGROUND ART 3D audio collectively refers to a series of signal processing, transmitting, encoding, and reproducing technologies for providing sound having presence in a 3D space by providing another axis corresponding to a height direction to a sound scene on a horizontal plane (2D) provided in surround audio in the related art. In particular, in order to provide the 3D audio, more speakers than the related art should be used or otherwise, even though less speakers than the related art are used, a rendering technique which makes a sound image at a virtual position where a speaker is not present is required.

It is anticipated that the 3D audio will be an audio solution corresponding to an ultra high definition (UHD) TV and it is anticipated that the 3D audio will be applied in various fields including theater sound, a personal 3DTV, a tablet, a smart phone, and a cloud game in addition to sound in a vehicle which evolves to a high-quality infotainment space.

Meanwhile, as a type of a sound source provided to the 3D audio, a channel based signal and an object based signal may be present. In addition, a sound source in which the channel based signal and the object based signal are mixed may be present, and as a result, a user may have a new type of listening experience.

Meanwhile, in an audio signal processing apparatus, a difference in performance may be present between a channel renderer for processing the channel based signal and an object renderer for processing the object based signal. That is to say, binaural rendering of the audio signal processing apparatus may be implemented based on the channel based signal. In this case, when a sound scene in which the channel based signal and the object based signal are mixed is received as an input of the audio signal processing apparatus, the corresponding sound scene may not be reproduced as intended through the binaural rendering. Accordingly, various problems need to be solved, which may occur due to the difference in performance between the channel renderer and the object renderer.

DISCLOSURE

Technical Problem

The present invention has been made in an effort to provide a method and an apparatus for processing an audio signal, which can produce an output signal which meets performance of a binaural renderer by implementing an object renderer and a channel renderer corresponding to a spatial resolution which can be provided by a binaural renderer.

The present invention has also been made in an effort to implement a filtering process which requires a high computational amount with very low computational amount while minimizing loss of sound quality in binaural rendering for conserving an immersive perception of an original signal in reproducing a multi-channel or multi-object signal in stereo.

The present invention has also been made in an effort to minimize spread of distortion through a high-quality filter when the distortion is contained in an input signal.

The present invention has also been made in an effort to implement a finite impulse response (FIR) filter having a very large length as a filter having a smaller length.

The present invention has also been made in an effort to minimize distortion of a destructed part by omitted filter coefficients when performing filtering using an abbreviated FIR filter.

Technical Solution

In order to achieve the objects, the present invention provides a method and an apparatus for processing an audio signal as below.

An exemplary embodiment of the present invention provides a method for processing an audio signal, including: receiving an input audio signal including a multi-channel signal; receiving truncated subband filter coefficients for filtering the input audio signal, the truncated subband filter coefficients being at least some of subband filter coefficients obtained from binaural room impulse response (BRIR) filter coefficients for binaural filtering of the input audio signal and the length of the truncated subband filter coefficients being determined based on filter order information obtained by at least partially using reverberation time information extracted from the corresponding subband filter coefficients; obtaining vector information indicating the BRIR filter coefficients corresponding to each channel of the input audio signal; and filtering each subband signal of the multi-channel signal by using the truncated subband filter coefficients corresponding to the relevant channel and subband based on the vector information.

Another exemplary embodiment of the present invention provides an apparatus for processing an audio signal for performing binaural rendering for an input audio signal, including: a parameterization unit generating a filter for the input audio signal; and a binaural rendering unit receiving the input audio signal including a multi-channel signal and filtering the input audio signal by using parameters generated by the parameterization unit, wherein the binaural rendering unit receives truncated subband filter coefficients for filtering the input audio signal from the parameterization unit, the truncated subband filter coefficients being at least some of subband filter coefficients obtained from binaural room impulse response (BRIR) filter coefficients for binaural filtering of the input audio signal and the length of the truncated subband filter coefficients being determined based on filter order information obtained by at least partially using reverberation time information extracted from the corresponding subband filter coefficients, obtains vector information indicating the BRIR filter coefficients corresponding to each channel of the input audio signal, and filters each subband signal of the multi-channel signal by using the truncated subband filter coefficients corresponding to the relevant channel and subband based on the vector information.

In this case, when BRIR filter coefficients having positional information matching with positional information of a specific channel of the input audio signal are present in a BRIR filter set, the vector information may indicate the relevant BRIR filter coefficients as BRIR filter coefficients corresponding to the specific channel.

Furthermore, when BRIR filter coefficients having positional information matching with positional information of a specific channel of the input audio signal are not present in a BRIR filter set, the vector information may indicate BRIR filter coefficients having a minimum geometric distance from the positional information of the specific channel as BRIR filter coefficients corresponding to the specific channel.

In this case, the geometric distance may be a value obtained by aggregating an absolute value of an altitude deviation between two positions and an absolute value of an azimuth deviation between the two positions.

The length of at least one truncated subband filter coefficients may be different from the length of truncated subband filter coefficients of another subband.

Yet another exemplary embodiment of the present invention provides a method for processing an audio signal, including: receiving a bitstream of an audio signal including at least one of a channel signal and an object signal; decoding each audio signal included in the bitstream; receiving virtual layout information corresponding to a binaural room impulse response (BRIR) filter set for binaural rendering of the audio signal, the virtual layout information including information on target channels determined based on the BRIR filter set; and rendering each decoded audio signal to the signal of the target channel base on the received virtual layout information.

Still yet another exemplary embodiment of the present invention provides an apparatus for processing an audio signal, including: a core decoder receiving a bitstream of an audio signal including at least one of a channel signal and an object signal and decoding each audio signal included in the bitstream; and a renderer receiving virtual layout information corresponding to a binaural room impulse response (BRIR) filter set for binaural rendering of the audio signal, the virtual layout information including information on target channels determined based on the BRIR filter set and rendering each decoded audio signal to the signal of the target channel based on the received virtual layout information.

In this case, a position set corresponding to the virtual layout information may be a subset of a position set corresponding to the BRIR filter set and the position set of the virtual layout information may indicate positional information of the respective target channels.

The BRIR filter set may be received from a binaural renderer performing the binaural rendering.

The apparatus may further include a mixer outputting output signals for each target channel by mixing each audio signal rendered to the signal of the target channel for each target channel.

The apparatus may further include a binaural renderer binaural-rendering the mixed output signals for each target channel by using BRIR filter coefficients of the BRIR filter set corresponding to the relevant target channel.

In this case, the binaural renderer may convert the BRIR filter coefficients into a plurality of subband filter coefficients, truncate each subband filter coefficients based on filter order information obtained by at least partially using reverberation time information extracted from the corresponding subband filter coefficients, in which the length of at least one truncated subband filter coefficients may be different from the length of the truncated subband filter coefficients of another subband, and filter each subband signal of the mixed output signals for each target channel by using the truncated subband filter coefficients corresponding to the relevant channel and subband.

Advantageous Effects

According to exemplary embodiments of the present invention, channel and object rendering is performed based on a data set possessed by a binaural renderer to implement effective binaural rendering.

In addition, when a binaural renderer having more data sets than channels is used, object rendering providing a more improved sound quality can be implemented.

In addition, according to the exemplary embodiments of the present invention, when the binaural rendering for a multi-channel or multi-object signal is performed, a computational amount can be significantly reduced while minimizing the loss of sound quality.

In addition, it is possible to achieve binaural rendering having high sound quality for a multi-channel or multi-object audio signal, which real-time processing has been impossible in a low-power device in the related art.

The present invention provides a method that efficiently performs filtering of various types of multimedia signals including an audio signal with a small computational amount.

BEST MODE

Terms used in the specification adopt general terms which are currently widely used as possible by considering functions in the present invention, but the terms may be changed depending on an intention of those skilled in the art, customs, or emergence of new technology. Further, in a specific case, terms arbitrarily selected by an applicant may be used and in this case, meanings thereof will be disclosed in the corresponding description part of the invention. Accordingly, we intend to discover that a term used in the specification should be analyzed based on not just a name of the term but a substantial meaning of the term and contents throughout the specification.

Figure 1:
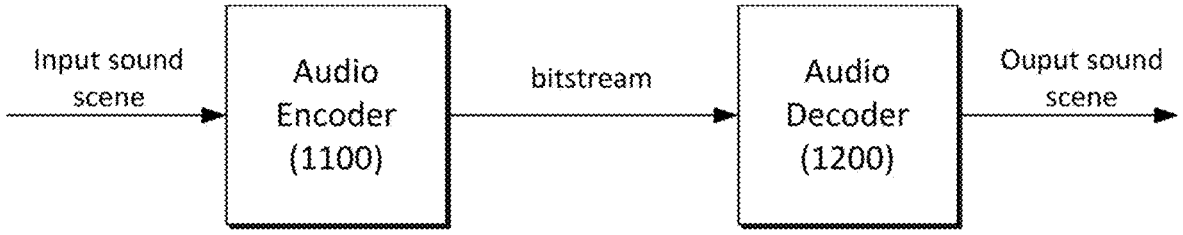
FIG. 1 is a configuration diagram illustrating an overall audio signal processing system including an audio encoder and an audio decoder according to an exemplary embodiment of the present invention.

FIG. 1 is a configuration diagram illustrating an overall audio signal processing system including an audio encoder and an audio decoder according to an exemplary embodiment of the present invention.

According to FIG. 1, an audio encoder 1100 encodes an input sound scene to generate a bitstream. An audio decoder 1200 may receive the generated bitstream and generate an output sound scene by decoding and rendering the corresponding bitstream by using a method for processing an audio signal according to an exemplary embodiment of the present invention. In the present specification, the audio signal processing apparatus may indicate an audio decoder 1200 as a narrow meaning, but the present invention is not limited thereto and the audio signal processing apparatus may indicate a detailed component included in the audio decoder 1200 or an overall audio signal processing system including the audio encoder 1100 and the audio decoder 1200.

Figure 2:
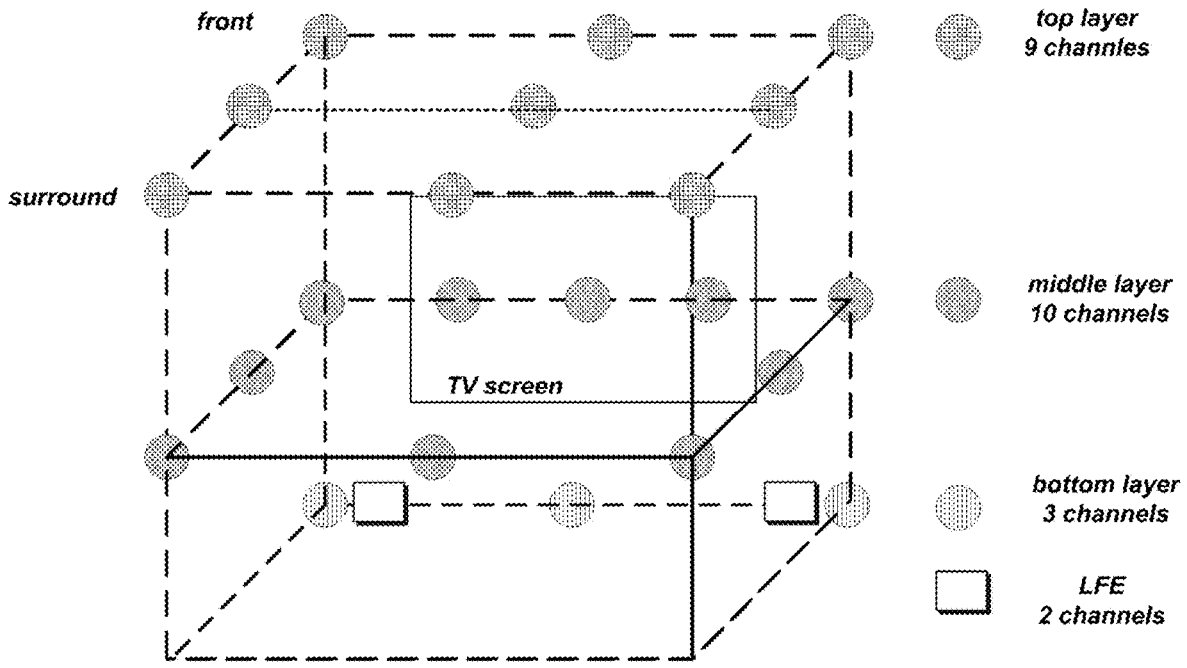
FIG. 2 is a configuration diagram illustrating a configuration of multi-channel speakers according to an exemplary embodiment of a multi-channel audio system.

FIG. 2 is a configuration diagram illustrating a configuration of multi-channel speakers according to an exemplary embodiment of a multi-channel audio system.

In the multi-channel audio system, a plurality of speaker channels may be used in order to improve presence and in particular, a plurality of speakers may be disposed in width, depth, and height directions in order to provide the presence in a 3D space. In FIG. 2 as an exemplary embodiment, a 22.2-channel speaker configuration is illustrated, but the present invention is not limited to the specific number of channels or a specific configuration of speakers. Referring to FIG. 2, a 22.2-channel speaker set may be constituted by three layers having a top layer, a middle layer, and a bottom layer. When a position of a TV screen is a front surface, on the top layer, three speakers are disposed on the front surface, three speakers are positioned at a middle position, and three speakers are positioned at a surround position, thereby a total of 9 speakers may be disposed. Further, on the middle layer, five speakers are disposed on the front surface, two speakers are disposed at the middle position, and three speakers are disposed at the surround position, thereby a total of 10 speakers may be disposed. Meanwhile, on the bottom layer, three speakers may be disposed on the front surface and two LFE channel speakers may be provided.

As described above, a large computational amount is required to transmit and reproduce the multi-channel signal having a maximum of tens of channels. Further, when a communication environment is considered, a high compression rate for the corresponding signal may be required. Moreover, in a general home, a user having a multi-channel speaker system such as 22.2 channels is extremely rare and there are a lot of cases in which a system having a 2-channel or 5.1-channel set-up is provided. Therefore, when a signal commonly transmitted to all users is a signal encoding each of the multi-channels, a process of converting the relevant multi-channel signal to correspond to 2-channels or 5.1-channels again is required. As a result, communicative inefficiency may be caused and since a 22.2-channel pulse code modulation (PCM) signal needs to be stored, a problem of inefficiency may occur even in memory management.

Figure 3:
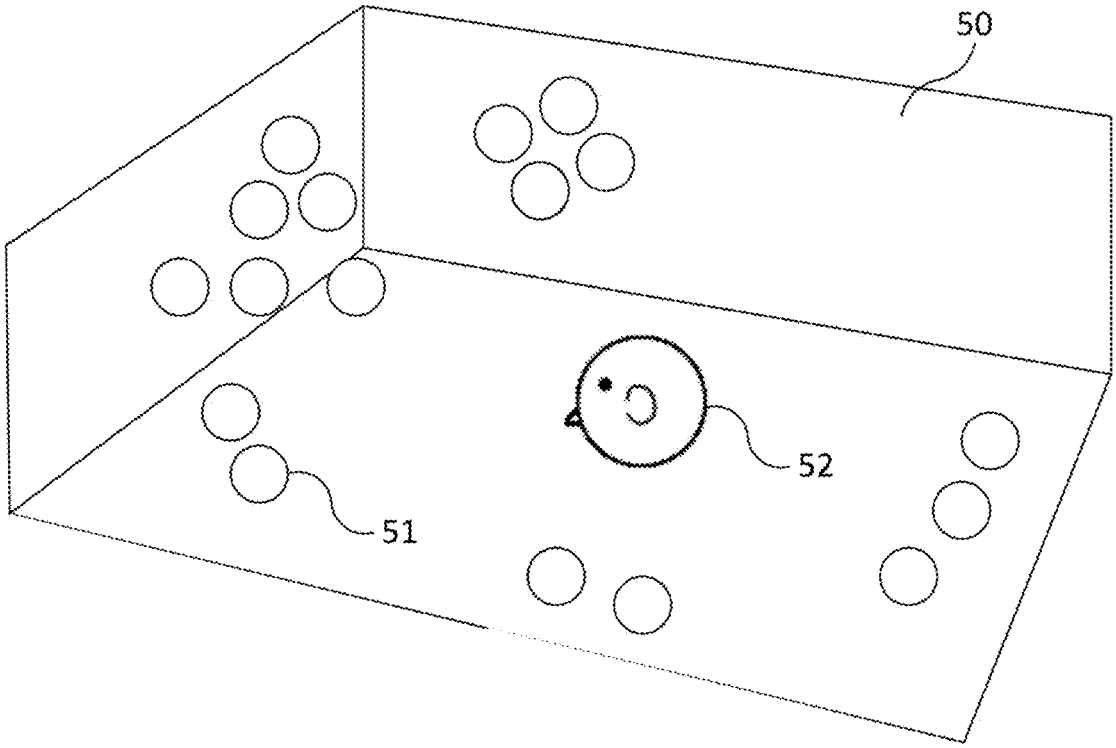
FIG. 3 is a diagram schematically illustrating positions of respective sound objects constituting a 3D sound scene in a listening space.

FIG. 3 is a diagram schematically illustrating positions of respective sound objects constituting a 3D sound scene in a listening space.

As illustrated in FIG. 3, in a listening space 50 where a listener 52 listens to 3D audio, respective sound objects 51 constituting a 3D sound scene may be distributed at various positions in the form of a point source. Moreover, the sound scene may include a plain wave type sound source or an ambient sound source in addition to the point source. As described above, an efficient rendering method is required to definitely provide the objects and sound sources which are variously distributed in the 3D space to the listener 52.

Figure 4:
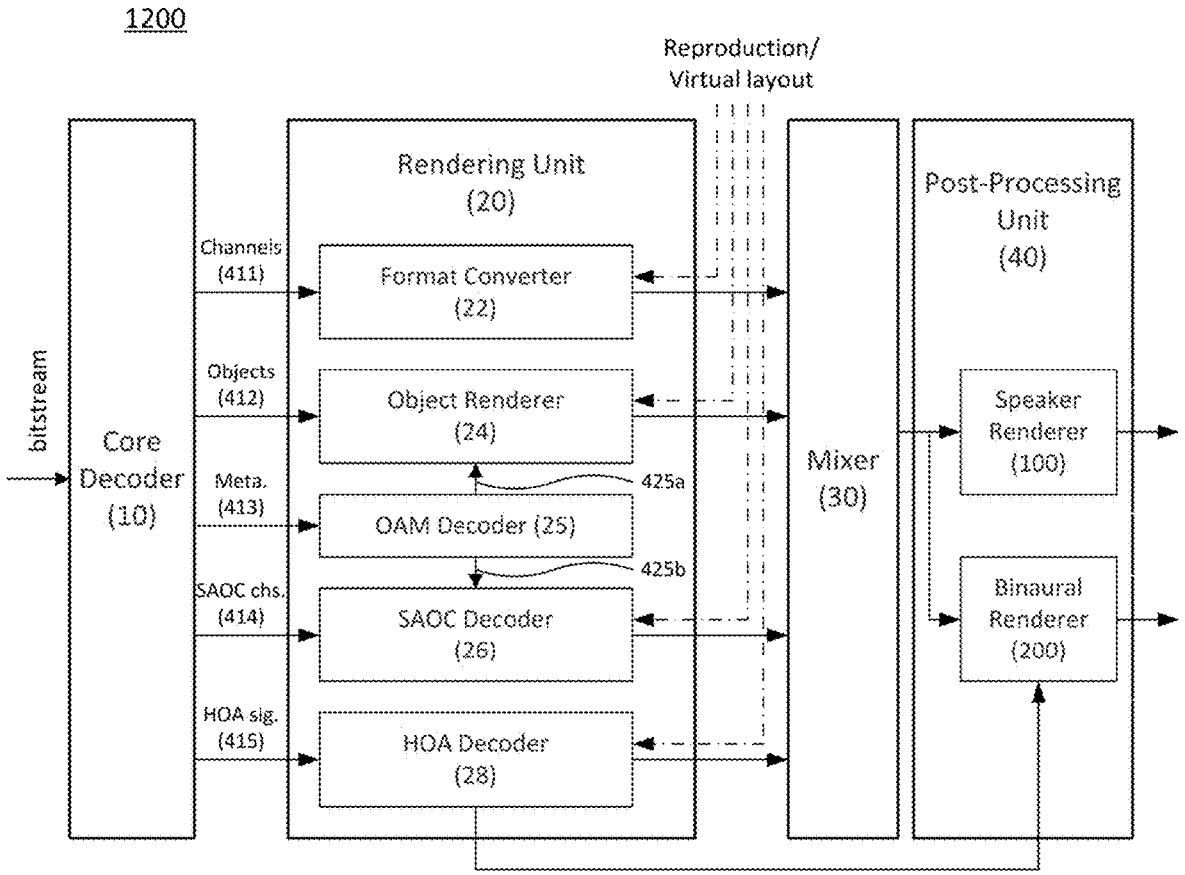
FIG. 4 is a block diagram illustrating an audio signal decoder according to an exemplary embodiment of the present invention.

FIG. 4 is a block diagram illustrating an audio decoder according to an additional exemplary embodiment of the present invention. The audio decoder 1200 of the present invention includes a core decoder 10, a rendering unit 20, a mixer 30, and a post-processing unit 40.

First, the core decoder 10 decodes the received bitstream and transfers the decoded bitstream to the rendering unit 20. In this case, the signal output from the core decoder 10 and transferred to the rendering unit may include a loudspeaker channel signal 411, an object signal 412, an SAOC channel signal 414, an HOA signal 415, and an object metadata bitstream 413. A core codec used for encoding in an encoder may be used for the core decoder 10 and for example, an MP3, AAC, AC3 or unified speech and audio coding (USAC) based codec may be used.

Meanwhile, the received bitstream may further include an identifier which may identify whether the signal decoded by the core decoder 10 is the channel signal, the object signal, or the HOA signal. Further, when the decoded signal is the channel signal 411, an identifier which may identify which channel in the multi-channels each signal corresponds to (for example, corresponding to a left speaker, corresponding to a top rear right speaker, and the like) may be further included in the bitstream. When the decoded signal is the object signal 412, information indicating at which position of the reproduction space the corresponding signal is reproduced may be additionally obtained like object metadata information 425*a* and 425*b* obtained by decoding the object metadata bitstream 413.

According to the exemplary embodiment of the present invention, the audio decoder performs flexible rendering to improve the quality of the output audio signal. The flexible rendering may mean a process of converting a format of the decoded audio signal based on a loudspeaker configuration (a reproduction layout) of an actual reproduction environment or a virtual speaker configuration (a virtual layout) of a binaural room impulse response (BRIR) filter set. In general, in speakers disposed in an actual living room environment, both an orientation angle and a distance are different from those of a standard recommendation. As a height, a direction, a distance from the listener of the speaker, and the like are different from the speaker configuration according to the standard recommendation, when an original signal is reproduced at a changed position of the speakers, it may be difficult to provide an ideal 3D sound scene. In order to effectively provide a sound scene intended by a contents producer even in the different speaker configurations, the flexible rendering is required, which corrects a change depending on a positional difference among the speakers by converting the audio signal.

Therefore, the rendering unit 20 renders the signal decoded by the core decoder 10 to a target output signal by using reproduction layout information or virtual layout information. The reproduction layout information may indicate a configuration of target channels and be expressed as loudspeaker layout information of the reproduction environment. Further, the virtual layout information may be obtained based on a binaural room impulse response (BRIR) filter set used in the binaural renderer 200 and a set of positions corresponding to the virtual layout may be constituted by a subset of a set of positions corresponding to the BRIR filter set. In this case, the set of positions of the virtual layout indicates positional information of respective target channels. The rendering unit 20 may include a format converter 22, an object renderer 24, an OAM decoder 25, an SAOC decoder 26, and an HOA decoder 28. The rendering unit 20 performs rendering by using at least one of the above configurations according to a type of the decoded signal.

The format converter 22 may also be referred to as a channel renderer and converts the transmitted channel signal 411 into the output speaker channel signal. That is, the format converter 22 performs conversion between the transmitted channel configuration and the speaker channel configuration to be reproduced. When the number of (for example, 5.1 channels) of output speaker channels is smaller than the number (for example, 22.2 channels) of transmitted channels or the transmitted channel configuration and the channel configuration to be reproduced are different from each other, the format converter 22 performs downmix or conversion of the channel signal 411. According to the exemplary embodiment of the present invention, the audio decoder may generate an optimal downmix matrix by using a combination between the input channel signal and the output speaker channel signal and perform the downmix by using the matrix. Further, a pre-rendered object signal may be included in the channel signal 411 processed by the format converter 22. According to the exemplary embodiment, at least one object signal may be pre-rendered and mixed to the channel signal before encoding the audio signal. The mixed object signal may be converted into the output speaker channel signal by the format converter 22 together with the channel signal.

The object renderer 24 and the SAOC decoder 26 performs rendering on the object based audio signal. The object based audio signal may include a discrete object waveform and a parametric object waveform. In the case of the discrete object waveform, the respective object signals are provided to the encoder in a monophonic waveform and the encoder transmits the respective object signals by using single channel elements (SCEs). In the case of the parametric object waveform, a plurality of object signals is downmixed to at least one channel signal and features of the respective objects and a relationship among the characteristics are expressed as a spatial audio object coding (SAOC) parameter. The object signals are downmixed and encoded with the core codec and in this case, the generated parametric information is transmitted together to the decoder.

Meanwhile, when the individual object waveforms or the parametric object waveform is transmitted to the audio decoder, compressed object metadata corresponding thereto may be transmitted together. The object metadata designates a position and a gain value of each object in the 3D space by quantizing an object attribute by the unit of a time and a space. The OAM decoder 25 of the rendering unit 20 receives a compressed object metadata bitstream 413 and decodes the received compressed object metadata bitstream 413 and transfers the decoded object metadata bitstream 413 to the object renderer 24 and/or the SAOC decoder 26.

The object renderer 24 performs rendering each object signal 412 according to a given reproduction format by using the object metadata information 425*a*. In this case, each object signal 412 may be rendered to specific output channels based on the object metadata information 425*a*. The SAOC decoder 26 restores the object/channel signal from the SAOC channel signal 414 and the parametric information. Further, the SAOC decoder 26 may generate the output audio signal based on the reproduction layout information and the object metadata information 425*b*. That is, the SAOC decoder 26 generates the decoded object signal by using the SAOC channel signal 414 and performs rendering of mapping the decoded object signal to the target output signal. As described above, the object renderer 24 and the SAOC decoder 26 may render the object signal to the channel signal.

The HOA decoder 28 receives the higher order ambisonics (HOA) signal 415 and HOA additional information and decodes the HOA signal and the HOA additional information. The HOA decoder 28 models the channel signal or the object signal by a separate equation to generate a sound scene. When a spatial position of a speaker is selected in the generated sound scene, the channel signal or the object signal may be rendered to a speaker channel signal.

Meanwhile, although not illustrated in FIG. 4, when the audio signal is transferred to the respective components of the rendering unit 20, dynamic range control (DRC) may be performed as a preprocessing procedure. The DRC limits a dynamic range of the reproduced audio signal to a predetermined level and adjusts sound smaller than a predetermined threshold to be larger and sound larger than the predetermined threshold to be smaller.

The channel based audio signal and object based audio signal processed by the rendering unit 20 are transferred to a mixer 30. The mixer 30 mixes partial signals rendered by respective sub-units of the rendering unit 20 to generate a mixer output signal. When the partial signals are matched with the same position on the reproduction/virtual layout, the partial signals are added to each other and when the partial signals are matched with positions which are not the same, the partial signals are mixed to output signals corresponding to separate positions, respectively. The mixer 30 may determine whether offset interference occurs in the partial signals which are added to each other and further perform an additional process for preventing the offset interference. Further, the mixer 30 adjusts delays of a channel based waveform and a rendered object waveform and aggregates the adjusted waveforms by the unit of a sample. The audio signal aggregated by the mixer 30 is transferred to a post-processing unit 40.

The post-processing unit 40 includes the speaker renderer 100 and the binaural renderer 200. The speaker renderer 100 performs post-processing for outputting the multi-channel and/or multi-object audio signal transferred from the mixer 30. The post-processing may include the dynamic range control (DRC), loudness normalization (LN), and a peak limiter (PL). The output signal of the speaker renderer 100 is transferred to a loudspeaker of the multi-channel audio system to be output.

The binaural renderer 200 generates a binaural downmix signal of the multi-channel and/or multi-object audio signals. The binaural downmix signal is a 2-channel audio signal that allows each input channel/object signal to be expressed by the virtual sound source positioned in 3D. The binaural renderer 200 may receive the audio signal supplied to the speaker renderer 100 as an input signal. The binaural rendering may be performed based on the binaural room impulse response (BRIR) filters and performed on a time domain or a QMF domain. According to the exemplary embodiment, as the post-processing procedure of the binaural rendering, the dynamic range control (DRC), the loudness normalization (LN), and the peak limiter (PL) may be additionally performed. The output signal of the binaural renderer 200 may be transferred and output to 2-channel audio output devices such as a head phone, an earphone, and the like.

Rendering Configuration Unit for Flexible Rendering

Figure 5:
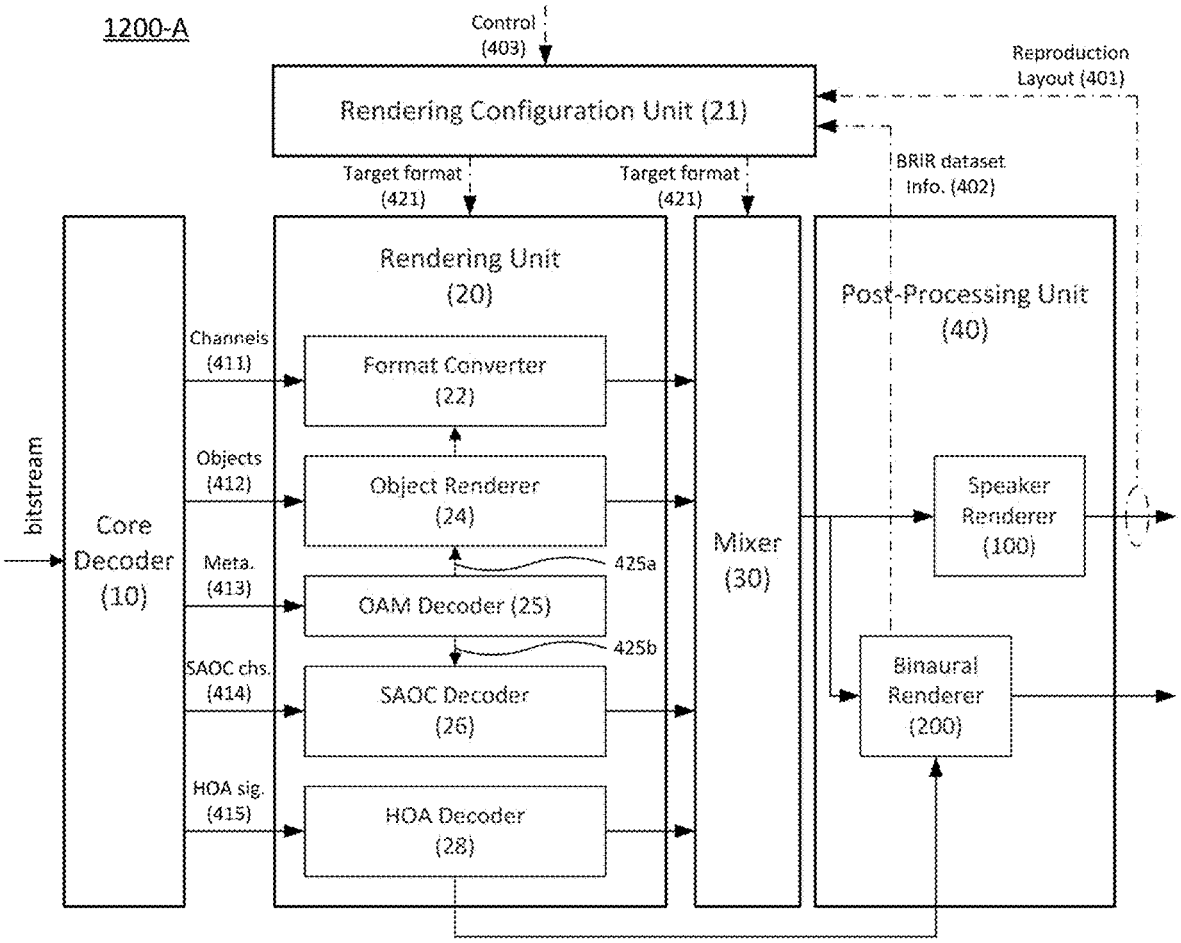
FIG. 5 is a block diagram illustrating an audio decoder according to an additional exemplary embodiment of the present invention.

FIG. 5 is a block diagram illustrating an audio decoder according to an additional exemplary embodiment of the present invention. In the exemplary embodiment of FIG. 5, the same reference numerals refer to the same elements as the exemplary embodiment of FIG. 4 and duplicated description will be omitted.

Referring to FIG. 5, an audio decoder 1200-A may further include a rendering configuration unit 21 controlling rendering of the decoded audio signal. The rendering configuration unit 21 receives reproduction layout information 401 and/or BRIR filter set information 402 and generates target format information 421 for rendering the audio signal by using the received reproduction layout information 401 and/or BRIR filter set information 402. According to the exemplary embodiment, the rendering configuration unit 21 may obtain the loudspeaker configuration of the actual reproduction environment as the reproduction layout information 401 and generate the target format information 421 based thereon. In this case, the target format information 421 may represent positions (channels) of the loudspeakers of the actual reproduction environment or subsets thereof or a superset based on a combination thereof.

The rendering configuration unit 21 may obtain the BRIR filter set information 402 from the binaural renderer 200 and generate the target format information 421 by using the obtained BRIR filter set information 402. In this case, the target format information 421 may represent target positions (channels) which are supported (that is, binaural-renderable) by the BRIR filter set of the binaural renderer 200 or the subsets thereof or the superset based on the combination thereof. According to the exemplary embodiment of the present invention, the BRIR filter set information 402 may include a target position different from the reproduction layout information 401 indicating a configuration of a physical loudspeaker or include more target positions. Therefore, when the audio signal rendered based on the reproduction layout information 401 is input into the binaural renderer 200, a difference between the target position of the rendered audio signal and the target position supported by the binaural renderer 200 may occur. Alternatively, the target position of the signal decoded by the core decoder 10 may be provided by the BRIR filter set information 402, but may not be provided by the reproduction layout information 401.

Therefore, when a final output audio signal is the binaural signal, the rendering configuration unit 21 of the present invention may generate the target format information 421 by using the BRIR filter set information 402 obtained from the binaural renderer 200. The rendering unit 20 performs rendering the audio signal by using the generated target format information 421 to minimize a sound quality deterioration phenomenon which may occur due to 2-step processing of rendering based on the reproduction layout information 401 and the binaural rendering.

Meanwhile, the rendering configuration unit 21 may further obtain information on a type of final output audio signal. When the final output audio signal is the loudspeaker signal, the rendering configuration unit 21 may generate the target format information 421 based on the reproduction layout information 401 and transfer the generated target format information 421 to the rendering unit 20. Further, when the final output audio signal is the binaural signal, the rendering configuration unit 21 may generate the target format information 421 based on the BRIR filter set information 402 and transfer the generated target format information 421 to the rendering unit 20. According to the additional exemplary embodiment of the present invention, the rendering configuration unit 21 may further obtain control information 403 indicating an audio system used by a user or an option of the user and generate the target format information 421 by using the corresponding control information 403 together.

The generated target format information 421 is transferred to the rendering unit 20. The respective sub-units of the rendering unit 20 may perform the flexible rendering by using the target format information 421 transferred from the rendering configuration unit 21. That is, the format converter 22 converts the decoded channel signal 411 into the output signal of the target channel based on the target format information 421. Similarly, the object renderer 24 and the SAOC decoder 26 convert the object signal 412 and the SAOC channel signal 414 into the output signals of the target channels, respectively by using the target format information 421 and the object metadata information 425. In this case, a mixing matrix for rendering the object signal 421 may be updated based on the target format information 421 and the object renderer 24 may render the object signal 412 to the output channel signal by using the updated mixing matrix. As described above, the rendering may be performed by a conversion process of mapping the audio signal to at least one target position (that is, target channel) on the target format.

Meanwhile, the target format information 421 may be transferred even to the mixer 30 and used in a process of mixing the partial signals rendered by the respective sub-units of the rendering unit 20. When the partial signals are matched with the same position on the target format, the partial signals are added to each other and when the partial signals are matched with a position which is not the same, the partial signals are mixed to the output signals corresponding to separate positions, respectively.

According to the exemplary embodiment of the present invention, the target format may be set according to various methods. First, the rendering configuration unit 21 may set the target format having a higher spatial resolution than the obtained reproduction layout information 401 or BRIR filter set information 402. That is, the rendering configuration unit 21 obtains a first target position set which is a set of original target positions indicated by the reproduction layout information 401 or the BRIR filter set information 402 and combines one or more original target positions to generate extra target positions. In this case, the extra target positions may include a position generated by interpolation among a plurality of original target positions, a position generated by extrapolation, and the like. With a set of the generated extra target positions, a second target position set may be configured. The rendering configuration unit 21 may generate the target format including the first target position set and the second target position set and transfer the corresponding target format information 421 to the rendering unit 20.

The rendering unit 20 may perform rendering the audio signal by using the high-resolution target format information 421 including the extra target position. When the rendering is performed by using the high-resolution target format information 421, the resolution of the rendering process is improved, and as a result, computation becomes easy and the sound quality is improved. The rendering unit 20 may obtain the output signal mapped to each target position of the target format information 421 through rendering the audio signal. When the output signal mapped to the additional target position of the second target position set is obtained, the rendering unit 20 may perform a downmix process of re-rendering the corresponding output signal to the original target position of the first target position set. In this case, the downmix process may be implemented through vector-based amplitude panning (VBAP) or amplitude panning.

As another method for setting the target format, the rendering configuration unit 21 may set the target format having a lower spatial resolution than the obtained BRIR filter set information 402. That is, the rendering configuration unit 21 may obtain N (N<M) abbreviated target positions through a subset of M original target positions or a combination thereof and generate the target format constituted by the abbreviated target positions. The rendering configuration unit 21 may transfer the corresponding low-resolution target format information 421 to the rendering unit 20 and the rendering unit 20 may perform rendering the audio signal by using the low-resolution target format information 421. When the rendering is performed by using the low-resolution target format information 421, a computational amount of the rendering unit 20 and a subsequent computational amount of the binaural renderer 200 may be reduced.

As yet another method for setting the target format, the rendering configuration unit 21 may set different target formats for each sub-unit of the rendering unit 20. For example, the target format provided to the format converter 20 and the target format provided to the object renderer 24 may be different from each other. When the different target formats are provided according to each sub-unit, the computational amount may be controlled or the sound quality may be improved for each sub-unit.

The rendering configuration unit 21 may differently set the target format provided to the rendering unit 20 and the target format provided to the mixer 30. For example, the target format provided to the rendering unit 20 may have a higher spatial resolution than the target format provided to the mixer 30. Accordingly, the mixer 30 may be implemented to accompany a process of downmixing an input signal having the high spatial resolution.

Meanwhile, the rendering configuration unit 21 may set the target format based on selection of the user, and an environment or a set-up of a used device. The rendering configuration unit 21 may receive the information through the control information 403. In this case the control information 403 varies based on at least one of computational amount performance and electric energy which may be provided by the device, and the option of the user.

In the exemplary embodiment of FIGS. 4 and 5, it is illustrated that the rendering unit 20 performs the rendering through different sub-units according to a rendering target signal, but the rendering unit 20 may be implemented through a renderer in which all or some sub-units are integrated. For example, the format converter 22 and the object renderer 24 may be implemented through one integrated renderer.

According to the exemplary embodiment of the present invention, as illustrated in FIG. 5, at least some of the output signals of the object renderer 24 may be input into the format converter 22. The output signals of the object renderer 24 input into the format converter 22 may be used as information for solving mismatch in the space, which may occur between both signals due to a difference in performance of flexible rendering for the object signal and flexible rendering for the channel signal. For example, when the object signal 412 and the channel signal 411 are simultaneously received as the inputs and a sound scene of a form in which both signals are mixed are intended to be provided, rendering processes for the respective signals are different from each other, and as a result, distortion easily occurs due to the mismatch in the space. Therefore, according to the exemplary embodiment of the present invention, when the object signal 412 and the channel signal 411 are simultaneously received as the inputs, the object renderer 24 may transfer the output signal to the format converter 22 without separately performing the flexible rendering based on the target format information 421. In this case, the output signal of the object renderer 24 transferred to the format converter 22 may be a signal corresponding to the channel format of the input channel signal 411. Further, the format converter 22 may mix the output signal of the object renderer 24 to the channel signal 411 and perform the flexible rendering based on the target format information 421 with respect to the mixed signal.

Meanwhile, in the case of an exceptional object positioned outside a usable speaker area, it is difficult to reproduce the sound intended by the contents producer only by the speaker in the related art. Therefore, when the exceptional object is present, the object renderer 24 may generate a virtual speaker corresponding to the position of the exceptional object and perform the rendering by using both actual loudspeaker information and virtual speaker information together.

Figure 6:
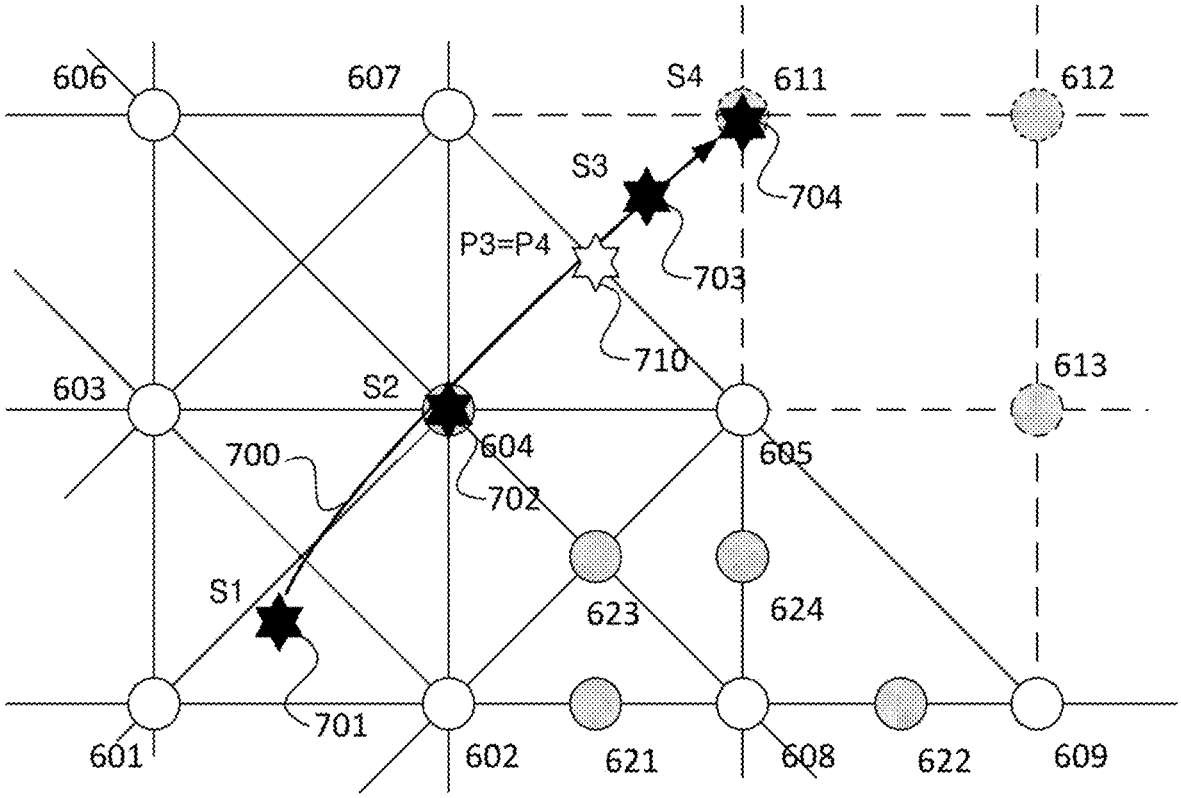
FIG. 6 is a diagram illustrating an exemplary embodiment of the present invention, which performs rendering on an exceptional object.

FIG. 6 is a diagram illustrating an exemplary embodiment of the present invention, which performs rendering an exceptional object. In FIG. 6, solid-line points marked by reference numerals 601 to 609 represent respective target positions supported by the target format and an area surrounded by the target positions forms an output channel space which may be rendered. Further, dotted-line points marked by reference numerals 611 to 613 represent virtual positions which are not supported by the target format and may represent the position of the virtual speaker generated by the object renderer 24. Meanwhile, star points marked by S1 701 to S4 704 represent spatial reproduction positions which need to be rendered at a specific time while a specific object S moves along a path 700. The spatial reproduction position of the object may be obtained based on the object metadata information 425.

In the exemplary embodiment of FIG. 6, the object signal may be rendered based on whether the reproduction position of the corresponding object matches the target position of the target format. When the reproduction position of the object matches a specific target position 604 like S2 702, the corresponding object signal is converted into the output signal of the target channel corresponding to the target position 604. That is, the object signal may be rendered by 1:1 mapping with the target channel. However, when the reproduction position of the object is positioned in the output channel space, but does not directly match the target position like S1 701, the corresponding object signal may be distributed to output signals of a plurality of target positions adjacent to the reproduction position. For example, the object signal of S1 701 may be rendered to output signals of adjacent target positions 601, 602, and 603. When the object signal is mapped to two or three target positions, the corresponding object signal may be rendered to the output signal of each target channel by a method such as vector-based amplitude panning (VBAP), or the like. Therefore, the object signal may be rendered by 1:N mapping with the plurality of target channels.

Meanwhile, when the reproduction position of the object is not positioned in the output channel space configured by the target format like S3 703 and S4 704, the corresponding object may be rendered through a separate process. According to the exemplary embodiment, the object renderer 24 may project the corresponding object onto the output channel space configured by the target format and perform the rendering from a projected position to an adjacent target position. In this case, for the rendering from the projected position to the target position, the rendering method of S1 701 or S2 702 may be used. That is, S3 703 and S4 704 are projected to P3 and P4 in the output channel space, respectively and signals of the projected P3 and P4 may be rendered to the output signals of the adjacent target positions 604, 605, and 607.

According to another exemplary embodiment, when the reproduction position of the object is not positioned in the output channel space configured by the target format, the object renderer 24 may render the corresponding object by using both the target position and the position of the virtual speaker together. First, the object renderer 24 renders the corresponding object signal to an output signal including at least one virtual speaker signal. For example, when the reproduction position of the object directly matches a position of a virtual speaker 611 like S4 704, the corresponding object signal is rendered to an output signal of the virtual speaker 611. However, when a virtual speaker matching the reproduction position of the object is not present like S3 703, the corresponding object signal may be rendered to the output signals of the adjacent virtual speaker 611 and target channels 605 and 607. Next, the object renderer 24 re-renders the rendered virtual speaker signal to the output signal of the target channel. That is, the signal of the virtual speaker 611 to which the object signal of S3 703 or S4 704 is rendered may be downmixed to the output signals of the adjacent target channels (for example, 605 and 607).

Meanwhile, as illustrated in FIG. 6, the target format may include extra target positions 621, 622, 623, and 624 generated by combining the original target positions. The extra target positions are generated and used as described above to increase the resolution of the rendering.

Binaural Renderer in Detail

Figure 7:
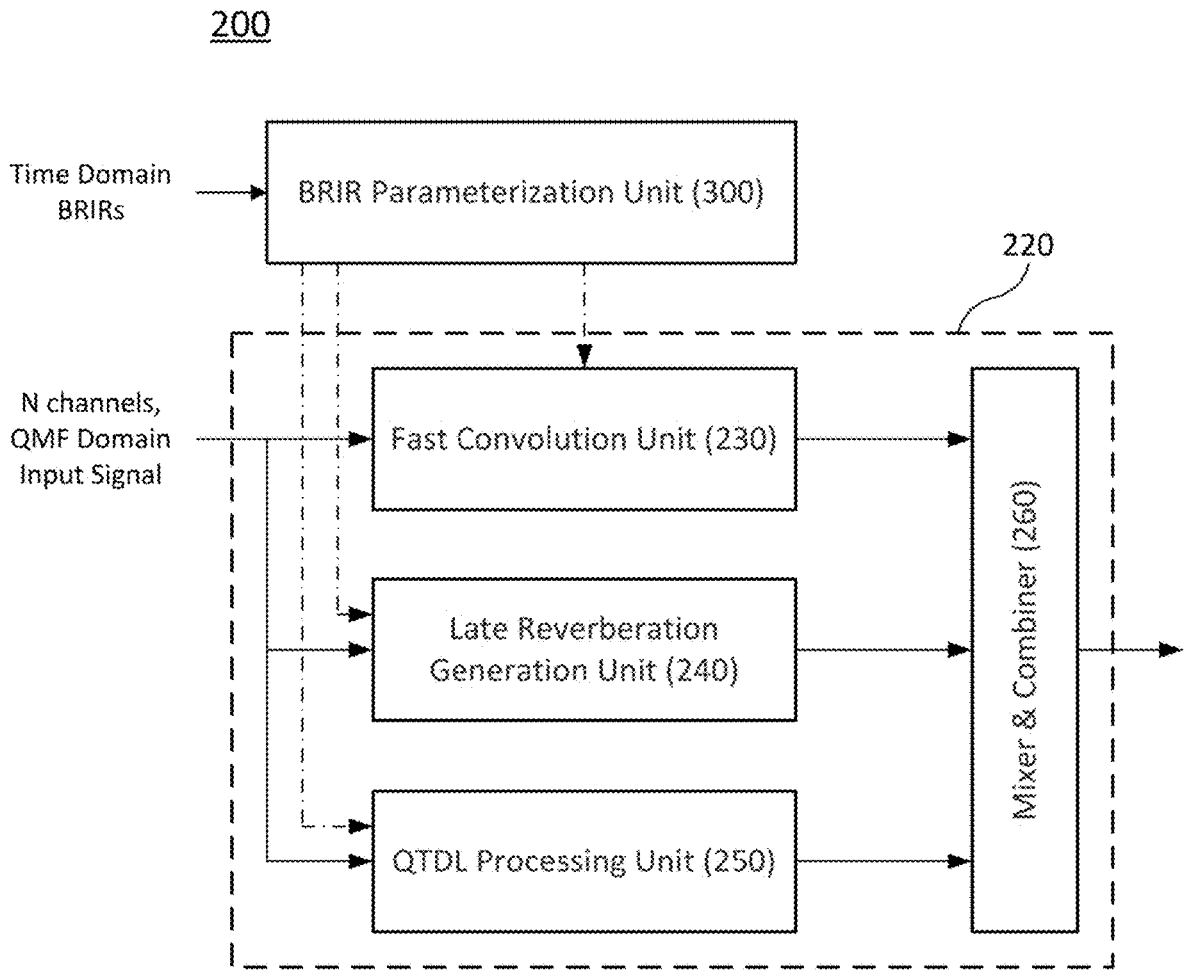
FIG. 7 is a block diagram illustrating respective components of a binaural renderer according to an exemplary embodiment of the present invention.

FIG. 7 is a block diagram illustrating each component of a binaural renderer according to an exemplary embodiment of the present invention. As illustrated in FIG. 2, the binaural renderer 200 according to the exemplary embodiment of the present invention may include a BRIR parameterization unit 300, a fast convolution unit 230, a late reverberation generation unit 240, a QTDL processing unit 250, and a mixer & combiner 260.

The binaural renderer 200 generates a 3D audio headphone signal (that is, a 3D audio 2-channel signal) by performing binaural rendering of various types of input signals. In this case, the input signal may be an audio signal including at least one of the channel signals (that is, the loudspeaker channel signals), the object signals, and the HOA coefficient signals. According to another exemplary embodiment of the present invention, when the binaural renderer 200 includes a particular decoder, the input signal may be an encoded bitstream of the aforementioned audio signal. The binaural rendering converts the decoded input signal into the binaural downmix signal to make it possible to experience a surround sound at the time of hearing the corresponding binaural downmix signal through a headphone.

The binaural renderer 200 according to the exemplary embodiment of the present invention may perform the binaural rendering by using binaural room impulse response (BRIR) filter. When the binaural rendering using the BRIR is generalized, the binaural rendering is M-to-O processing for acquiring O output signals for the multi-channel input signals having M channels. Binaural filtering may be regarded as filtering using filter coefficients corresponding to each input channel and each output channel during such a process. In FIG. 3, an original filter set H means transfer functions up to locations of left and right ears from a speaker location of each channel signal. A transfer function measured in a general listening room, that is, a reverberant space among the transfer functions is referred to as the binaural room impulse response (BRIR). On the contrary, a transfer function measured in an anechoic room so as not to be influenced by the reproduction space is referred to as a head related impulse response (HRIR), and a transfer function therefor is referred to as a head related transfer function (HRTF). Accordingly, differently from the HRTF, the BRIR contains information of the reproduction space as well as directional information. According to an exemplary embodiment, the BRIR may be substituted by using the HRTF and an artificial reverberator. In the specification, the binaural rendering using the BRIR is described, but the present invention is not limited thereto, and the present invention may be applied even to the binaural rendering using various types of FIR filters including HRIR and HRTF by a similar or a corresponding method. Furthermore, the present invention can be applied to various forms of filterings for input signals as well as the binaural rendering for the audio signals. Meanwhile, the BRIR may have a length of 96K samples as described above, and since multi-channel binaural rendering is performed by using different M*O filters, a processing process with a high computational complexity is required.

In the present invention, the apparatus for processing an audio signal may indicate the binaural renderer 200 or the binaural rendering unit 220, which is illustrated in FIG. 7, as a narrow meaning. However, in the present invention, the apparatus for processing an audio signal may indicate the audio signal decoder of FIG. 4 or FIG. 5, which includes the binaural renderer, as a broad meaning. Further, hereinafter, in the specification, an exemplary embodiment of the multi-channel input signals will be primarily described, but unless otherwise described, a channel, multi-channels, and the multi-channel input signals may be used as concepts including an object, multi-objects, and the multi-object input signals, respectively. Moreover, the multi-channel input signals may also be used as a concept including an HOA decoded and rendered signal.

According to the exemplary embodiment of the present invention, the binaural renderer 200 may perform the binaural rendering of the input signal in the QMF domain. That is to say, the binaural renderer 200 may receive signals of multi-channels (N channels) of the QMF domain and perform the binaural rendering for the signals of the multi-channels by using a BRIR subband filter of the QMF domain. When a k-th subband signal of an i-th channel, which passed through a QMF analysis filter bank, is represented by $x_{k,i}(l)$ and a time index in a subband domain is represented by 1, the binaural rendering in the QMF domain may be expressed by an equation given below.

$$y_k^m(l) = \sum_i x_{k,i}(l) * b_{k,i}^m(l) \quad \text{[Equation 1]}$$

Herein, m is L (left) or R (right), and $b_{k,i}^m(l)$ is obtained by converting the time domain BRIR filter into the subband filter of the QMF domain.

That is, the binaural rendering may be performed by a method that divides the channel signals or the object signals of the QMF domain into a plurality of subband signals and convolutes the respective subband signals with BRIR subband filters corresponding thereto, and thereafter, sums up the respective subband signals convoluted with the BRIR subband filters.

The BRIR parameterization unit 300 converts and edits BRIR filter coefficients for the binaural rendering in the QMF domain and generates various parameters. First, the BRIR parameterization unit 300 receives time domain BRIR filter coefficients for multi-channels or multi-objects, and converts the received time domain BRIR filter coefficients into QMF domain BRIR filter coefficients. In this case, the QMF domain BRIR filter coefficients include a plurality of subband filter coefficients corresponding to a plurality of frequency bands, respectively. In the present invention, the subband filter coefficients indicate each BRIR filter coefficients of a QMF-converted subband domain. In the specification, the subband filter coefficients may be designated as the BRIR subband filter coefficients. The BRIR parameterization unit 300 may edit each of the plurality of BRIR subband filter coefficients of the QMF domain and transfer the edited subband filter coefficients to the fast convolution unit 230, and the like. According to the exemplary embodiment of the present invention, the BRIR parameterization unit 300 may be included as a component of the binaural renderer 200 and, otherwise provided as a separate apparatus. According to an exemplary embodiment, a component including the fast convolution unit 230, the late reverberation generation unit 240, the QTDL processing unit 250, and the mixer & combiner 260, except for the BRIR parameterization unit 300, may be classified into a binaural rendering unit 220.

According to an exemplary embodiment, the BRIR parameterization unit 300 may receive BRIR filter coefficients corresponding to at least one location of a virtual reproduction space as an input. Each location of the virtual reproduction space may correspond to each speaker location of a multi-channel system. According to an exemplary embodiment, each of the BRIR filter coefficients received by the BRIR parameterization unit 300 may directly match each channel or each object of the input signal of the binaural renderer 200. On the contrary, according to another exemplary embodiment of the present invention, each of the received BRIR filter coefficients may have an independent configuration from the input signal of the binaural renderer 200. That is, at least a part of the BRIR filter coefficients received by the BRIR parameterization unit 300 may not directly match the input signal of the binaural renderer 200, and the number of received BRIR filter coefficients may be smaller or larger than the total number of channels and/or objects of the input signal.

The BRIR parameterization unit 300 may additionally receive control parameter information and generate a parameter for the binaural rendering based on the received control parameter information. The control parameter information may include a complexity-quality control parameter, and the like as described in an exemplary embodiment described below and be used as a threshold for various parameterization processes of the BRIR parameterization unit 300. The BRIR parameterization unit 300 generates a binaural rendering parameter based on the input value and transfers the generated binaural rendering parameter to the binaural rendering unit 220. When the input BRIR filter coefficients or the control parameter information is to be changed, the BRIR parameterization unit 300 may recalculate the binaural rendering parameter and transfer the recalculated binaural rendering parameter to the binaural rendering unit.

According to the exemplary embodiment of the present invention, the BRIR parameterization unit 300 converts and edits the BRIR filter coefficients corresponding to each channel or each object of the input signal of the binaural renderer 200 to transfer the converted and edited BRIR filter coefficients to the binaural rendering unit 220. The corresponding BRIR filter coefficients may be a matching BRIR or a fallback BRIR selected from BRIR filter set for each channel or each object. The BRIR matching may be determined whether BRIR filter coefficients targeting the location of each channel or each object are present in the virtual reproduction space. In this case, positional information of each channel (or object) may be obtained from an input parameter which signals the channel arrangement. When the BRIR filter coefficients targeting at least one of the locations of the respective channels or the respective objects of the input signal are present, the BRIR filter coefficients may be the matching BRIR of the input signal. However, when the BRIR filter coefficients targeting the location of a specific channel or object is not present, the BRIR parameterization unit 300 may provide BRIR filter coefficients, which target a location most similar to the corresponding channel or object, as the fallback BRIR for the corresponding channel or object.

First, when BRIR filter coefficients having altitude and azimuth deviations within a predetermined range from a desired position (a specific channel or object) are present in the BRIR filter set, the corresponding BRIR filter coefficients may be selected. In other words, BRIR filter coefficients having the same altitude as and an azimuth deviation within +/−20 from the desired position may be selected. When BRIR filter coefficients corresponding thereto are not present, BRIR filter coefficients having a minimum geometric distance from the desired position in a BRIR filter set may be selected. That is, BRIR filter coefficients that minimize a geometric distance between the position of the corresponding BRIR and the desired position may be selected. Herein, the position of the BRIR represents a position of the speaker corresponding to the relevant BRIR filter coefficients. Further, the geometric distance between both positions may be defined as a value obtained by aggregating an absolute value of an altitude deviation and an absolute value of an azimuth deviation between both positions. Meanwhile, according to the exemplary embodiment, by a method for interpolating the BRIR filter coefficients, the position of the BRIR filter set may be matched up with the desired position. In this case, the interpolated BRIR filter coefficients may be regarded as a part of the BRIR filter set. That is, in this case, it may be implemented that the BRIR filter coefficients are always present at the desired position.

The BRIR filter coefficients corresponding to each channel or each object of the input signal may be transferred through separate vector information $m_{conv}$. The vector information $m_{conv}$ indicates the BRIR filter coefficients corresponding to each channel or object of the input signal in the BRIR filter set. For example, when BRIR filter coefficients having positional information matching with positional information of a specific channel of the input signal are present in the BRIR filter set, the vector information $m_{conv}$ indicates the relevant BRIR filter coefficients as BRIR filter coefficients corresponding to the specific channel. However, the vector information $m_{conv}$ indicates fallback BRIR filter coefficients having a minimum geometric distance from positional information of the specific channel as the BRIR filter coefficients corresponding to the specific channel when the BRIR filter coefficients having positional information matching positional information of the specific channel of the input signal are not present in the BRIR filter set. Accordingly, the parameterization unit 300 may determine the BRIR filter coefficients corresponding to each channel or object of the input audio signal in the entire BRIR filter set by using the vector information $m_{conv}$.

Meanwhile, according to another exemplary embodiment of the present invention, the BRIR parameterization unit 300 converts and edits all of the received BRIR filter coefficients to transfer the converted and edited BRIR filter coefficients to the binaural rendering unit 220. In this case, a selection procedure of the BRIR filter coefficients (alternatively, the edited BRIR filter coefficients) corresponding to each channel or each object of the input signal may be performed by the binaural rendering unit 220.

When the BRIR parameterization unit 300 is constituted by a device apart from the binaural rendering unit 220, the binaural rendering parameter generated by the BRIR parameterization unit 300 may be transmitted to the binaural rendering unit 220 as a bitstream. The binaural rendering unit 220 may obtain the binaural rendering parameter by decoding the received bitstream. In this case, the transmitted binaural rendering parameter includes various parameters required for processing in each sub-unit of the binaural rendering unit 220 and may include the converted and edited BRIR filter coefficients, or the original BRIR filter coefficients.

The binaural rendering unit 220 includes a fast convolution unit 230, a late reverberation generation unit 240, and a QTDL processing unit 250 and receives multi-audio signals including multi-channel and/or multi-object signals. In the specification, the input signal including the multi-channel and/or multi-object signals will be referred to as the multi-audio signals. FIG. 7 illustrates that the binaural rendering unit 220 receives the multi-channel signals of the QMF domain according to an exemplary embodiment, but the input signal of the binaural rendering unit 220 may further include time domain multi-channel signals and time domain multi-object signals. Further, when the binaural rendering unit 220 additionally includes a particular decoder, the input signal may be an encoded bitstream of the multi-audio signals. Moreover, in the specification, the present invention is described based on a case of performing BRIR rendering of the multi-audio signals, but the present invention is not limited thereto. That is, features provided by the present invention may be applied to not only the BRIR but also other types of rendering filters and applied to not only the multi-audio signals but also an audio signal of a single channel or single object.

The fast convolution unit 230 performs a fast convolution between the input signal and the BRIR filter to process direct sound and early reflections sound for the input signal. To this end, the fast convolution unit 230 may perform the fast convolution by using a truncated BRIR. The truncated BRIR includes a plurality of subband filter coefficients truncated dependently on each subband frequency and is generated by the BRIR parameterization unit 300. In this case, the length of each of the truncated subband filter coefficients is determined dependently on a frequency of the corresponding subband. The fast convolution unit 230 may perform variable order filtering in a frequency domain by using the truncated subband filter coefficients having different lengths according to the subband. That is, the fast convolution may be performed between QMF domain subband signals and the truncated subband filters of the QMF domain corresponding thereto for each frequency band. The truncated subband filter corresponding to each subband signal may be identified by the vector information $m_{conv}$ given above.

The late reverberation generation unit 240 generates a late reverberation signal for the input signal. The late reverberation signal represents an output signal which follows the direct sound and the early reflections sound generated by the fast convolution unit 230. The late reverberation generation unit 240 may process the input signal based on reverberation time information determined by each of the subband filter coefficients transferred from the BRIR parameterization unit 300. According to the exemplary embodiment of the present invention, the late reverberation generation unit 240 may generate a mono or stereo downmix signal for an input audio signal and perform late reverberation processing of the generated downmix signal.

The QMF domain tapped delay line (QTDL) processing unit 250 processes signals in high-frequency bands among the input audio signals. The QTDL processing unit 250 receives at least one parameter, which corresponds to each subband signal in the high-frequency bands, from the BRIR parameterization unit 300 and performs tap-delay line filtering in the QMF domain by using the received parameter. The parameter corresponding to each subband signal may be identified by the vector information $m_{conv}$ given above. According to the exemplary embodiment of the present invention, the binaural renderer 200 separates the input audio signals into low-frequency band signals and high-frequency band signals based on a predetermined constant or a predetermined frequency band, and the low-frequency band signals may be processed by the fast convolution unit 230 and the late reverberation generation unit 240, and the high frequency band signals may be processed by the QTDL processing unit 250, respectively.

Each of the fast convolution unit 230, the late reverberation generation unit 240, and the QTDL processing unit 250 outputs the 2-channel QMF domain subband signal. The mixer & combiner 260 combines and mixes the output signal of the fast convolution unit 230, the output signal of the late reverberation generation unit 240, and the output signal of the QTDL processing unit 250. In this case, the combination of the output signals is performed separately for each of left and right output signals of 2 channels. The binaural renderer 200 performs QMF synthesis to the combined output signals to generate a final binaural output audio signal in the time domain.

Variable Order Filtering in Frequency-Domain (VOFF)

Figure 8:
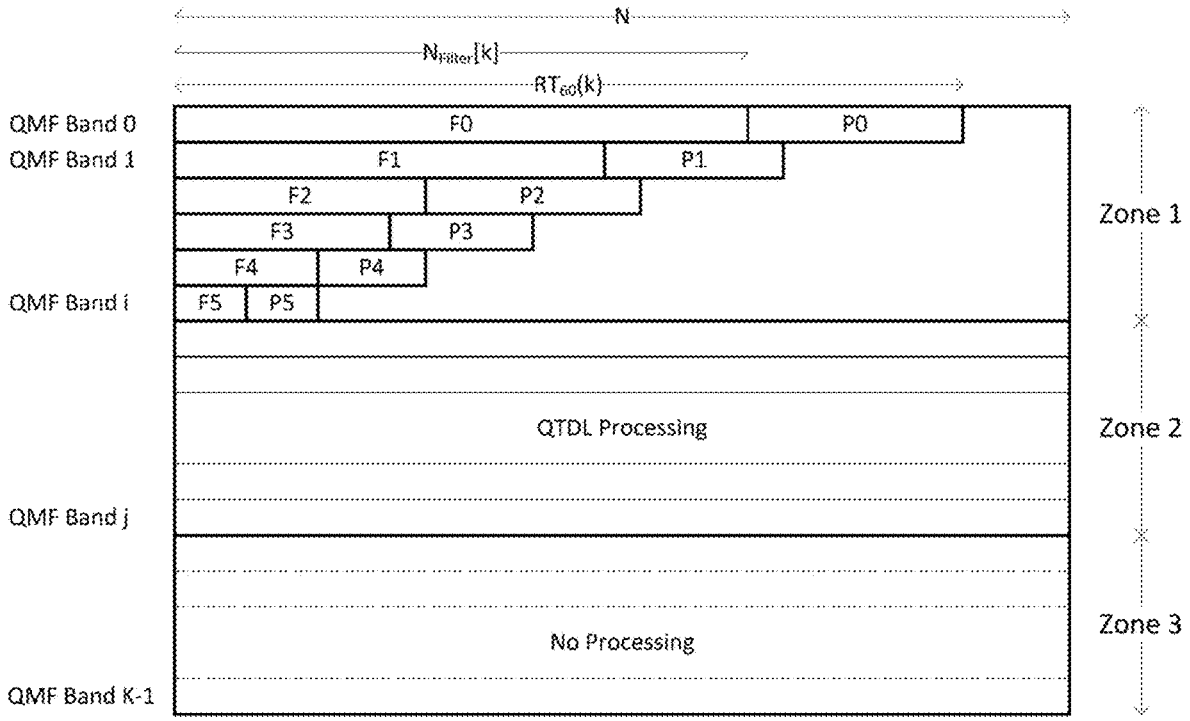
FIG. 8 is a diagram illustrating a filter generating method for binaural rendering according to an exemplary embodiment of the present invention.

FIG. 8 is a diagram illustrating a filter generating method for binaural rendering according to an exemplary embodiment of the present invention. An FIR filter converted into a plurality of subband filters may be used for binaural rendering in a QMF domain. According to the exemplary embodiment of the present invention, the fast convolution unit of the binaural renderer may perform variable order filtering in the QMF domain by using the truncated subband filters having different lengths according to each subband frequency.

In FIG. 8, Fk represents the truncated subband filter used for the fast convolution in order to process direct sound and early reflection sound of QMF subband k. Further, Pk represents a filter used for late reverberation generation of QMF subband k. In this case, the truncated subband filter Fk may be a front filter truncated from an original subband filter and be also designated as a front subband filter. Further, Pk may be a rear filter after truncation of the original subband filter and be also designated as a rear subband filter. The QMF domain has a total of K subbands and according to the exemplary embodiment, 64 subbands may be used. Further, N represents a length (tab number) of the original subband filter and $N_{Filter}[k]$ represents a length of the front subband filter of subband k. In this case, the length $N_{Filter}[k]$ represents the number of tabs in the QMF domain which is down-sampled.

In the case of rendering using the BRIR filter, a filter order (that is, filter length) for each subband may be determined based on parameters extracted from an original BRIR filter, that is, reverberation time (RT) information for each subband filter, an energy decay curve (EDC) value, energy decay time information, and the like. A reverberation time may vary depending on the frequency due to acoustic characteristics in which decay in air and a sound-absorption degree depending on materials of a wall and a ceiling vary for each frequency. In general, a signal having a lower frequency has a longer reverberation time. Since the long reverberation time means that more information remains in the rear part of the FIR filter, it is preferable to truncate the corresponding filter long in normally transferring reverberation information. Accordingly, the length of each truncated subband filter Fk of the present invention is determined based at least in part on the characteristic information (for example, reverberation time information) extracted from the corresponding subband filter.

According to an embodiment, the length of the truncated subband filter Fk may be determined based on additional information obtained by the apparatus for processing an audio signal, that is, complexity, a complexity level (profile), or required quality information of the decoder. The complexity may be determined according to a hardware resource of the apparatus for processing an audio signal or a value directly input by the user. The quality may be determined according to a request of the user or determined with reference to a value transmitted through the bitstream or other information included in the bitstream. Further, the quality may also be determined according to a value obtained by estimating the quality of the transmitted audio signal, that is to say, as a bit rate is higher, the quality may be regarded as a higher quality. In this case, the length of each truncated subband filter may proportionally increase according to the complexity and the quality and may vary with different ratios for each band. Further, in order to acquire an additional gain by high-speed processing such as FFT, and the like, the length of each truncated subband filter may be determined as a corresponding size unit, for example to say, a multiple of the power of 2. On the contrary, when the determined length of the truncated subband filter is longer than a total length of an actual subband filter, the length of the truncated subband filter may be adjusted to the length of the actual subband filter.

The BRIR parameterization unit according to the embodiment of the present invention generates the truncated subband filter coefficients corresponding to the respective lengths of the truncated subband filters determined according to the aforementioned exemplary embodiment, and transfers the generated truncated subband filter coefficients to the fast convolution unit. The fast convolution unit performs the variable order filtering in frequency domain (VOFF processing) of each subband signal of the multi-audio signals by using the truncated subband filter coefficients. That is, in respect to a first subband and a second subband which are different frequency bands with each other, the fast convolution unit generates a first subband binaural signal by applying a first truncated subband filter coefficients to the first subband signal and generates a second subband binaural signal by applying a second truncated subband filter coefficients to the second subband signal. In this case, each of the first truncated subband filter coefficients and the second truncated subband filter coefficients may have different lengths independently and is obtained from the same proto-type filter in the time domain. That is, since a single filter in the time domain is converted into a plurality of QMF subband filters and the lengths of the filters corresponding to the respective subbands vary, each of the truncated subband filters is obtained from a single proto-type filter.

Meanwhile, according to an exemplary embodiment of the present invention, the plurality of subband filters, which are QMF-converted, may be classified into the plurality of groups, and different processing may be applied for each of the classified groups. For example, the plurality of subbands may be classified into a first subband group Zone 1 having low frequencies and a second subband group Zone 2 having high frequencies based on a predetermined frequency band (QMF band i). In this case, the VOFF processing may be performed with respect to input subband signals of the first subband group, and QTDL processing to be described below may be performed with respect to input subband signals of the second subband group.

Accordingly, the BRIR parameterization unit generates the truncated subband filter (the front subband filter) coefficients for each subband of the first subband group and transfers the front subband filter coefficients to the fast convolution unit. The fast convolution unit performs the VOFF processing of the subband signals of the first subband group by using the received front subband filter coefficients. According to an exemplary embodiment, a late reverberation processing of the subband signals of the first subband group may be additionally performed by the late reverberation generation unit. Further, the BRIR parameterization unit obtains at least one parameter from each of the subband filter coefficients of the second subband group and transfers the obtained parameter to the QTDL processing unit. The QTDL processing unit performs tap-delay line filtering of each subband signal of the second subband group as described below by using the obtained parameter. According to the exemplary embodiment of the present invention, the predetermined frequency (QMF band i) for distinguishing the first subband group and the second subband group may be determined based on a predetermined constant value or determined according to a bitstream characteristic of the transmitted audio input signal. For example, in the case of the audio signal using the SBR, the second subband group may be set to correspond to an SBR bands.

According to another exemplary embodiment of the present invention, the plurality of subbands may be classified into three subband groups based on a predetermined first frequency band (QMF band i) and a second frequency band (QMF band j) as illustrated in FIG. 8. That is, the plurality of subbands may be classified into a first subband group Zone 1 which is a low-frequency zone equal to or lower than the first frequency band, a second subband group Zone 2 which is an intermediate-frequency zone higher than the first frequency band and equal to or lower than the second frequency band, and a third subband group Zone 3 which is a high-frequency zone higher than the second frequency band. For example, when a total of 64 QMF subbands (subband indexes 0 to 63) are divided into the 3 subband groups, the first subband group may include a total of 32 subbands having indexes 0 to 31, the second subband group may include a total of 16 subbands having indexes 32 to 47, and the third subband group may include subbands having residual indexes 48 to 63. Herein, the subband index has a lower value as a subband frequency becomes lower.

According to the exemplary embodiment of the present invention, the binaural rendering may be performed only with respect to subband signals of the first subband group and the second subband groups. That is, as described above, the VOFF processing and the late reverberation processing may be performed with respect to the subband signals of the first subband group and the QTDL processing may be performed with respect to the subband signals of the second subband group. Further, the binaural rendering may not be performed with respect to the subband signals of the third subband group. Meanwhile, information (Kproc=48) of a maximum frequency band to perform the binaural rendering and information (Kconv=32) of a frequency band to perform the convolution may be predetermined values or be determined by the BRIR parameterization unit to be transferred to the binaural rendering unit. In this case, a first frequency band (QMF band i) is set as a subband of an index Kconv−1 and a second frequency band (QMF band j) is set as a subband of an index Kproc−1. Meanwhile, the values of the information (Kproc) of the maximum frequency band and the information (Kconv) of the frequency band to perform the convolution may vary by a sampling frequency of an original BRIR input, a sampling frequency of an input audio signal, and the like.

Meanwhile, according to the exemplary embodiment of FIG. 8, the length of the rear subband filter Pk may also be determined based on the parameters extracted from the original subband filter as well as the front subband filter Fk. That is, the lengths of the front subband filter and the rear subband filter of each subband are determined based at least in part on the characteristic information extracted in the corresponding subband filter. For example, the length of the front subband filter may be determined based on first reverberation time information of the corresponding subband filter, and the length of the rear subband filter may be determined based on second reverberation time information. That is, the front subband filter may be a filter at a truncated front part based on the first reverberation time information in the original subband filter, and the rear subband filter may be a filter at a rear part corresponding to a zone between a first reverberation time and a second reverberation time as a zone which follows the front subband filter. According to an exemplary embodiment, the first reverberation time information may be RT20, and the second reverberation time information may be RT60, but the present invention is not limited thereto.

A part where an early reflections sound part is switched to a late reverberation sound part is present within a second reverberation time. That is, a point is present, where a zone having a deterministic characteristic is switched to a zone having a stochastic characteristic, and the point is called a mixing time in terms of the BRIR of the entire band. In the case of a zone before the mixing time, information providing directionality for each location is primarily present, and this is unique for each channel. On the contrary, since the late reverberation part has a common feature for each channel, it may be efficient to process a plurality of channels at once. Accordingly, the mixing time for each subband is estimated to perform the fast convolution through the VOFF processing before the mixing time and perform processing in which a common characteristic for each channel is reflected through the late reverberation processing after the mixing time.

However, an error may occur by a bias from a perceptual viewpoint at the time of estimating the mixing time. Therefore, performing the fast convolution by maximizing the length of the VOFF processing part is more excellent from a quality viewpoint than separately processing the VOFF processing part and the late reverberation part based on the corresponding boundary by estimating an accurate mixing time. Therefore, the length of the VOFF processing part, that is, the length of the front subband filter may be longer or shorter than the length corresponding to the mixing time according to complexity-quality control.

Moreover, in order to reduce the length of each subband filter, in addition to the aforementioned truncation method, when a frequency response of a specific subband is monotonic, a modeling of reducing the filter of the corresponding subband to a low order is available. As a representative method, there is FIR filter modeling using frequency sampling, and a filter minimized from a least square viewpoint may be designed.

QTDL Processing of High-Frequency Bands

Figure 9:
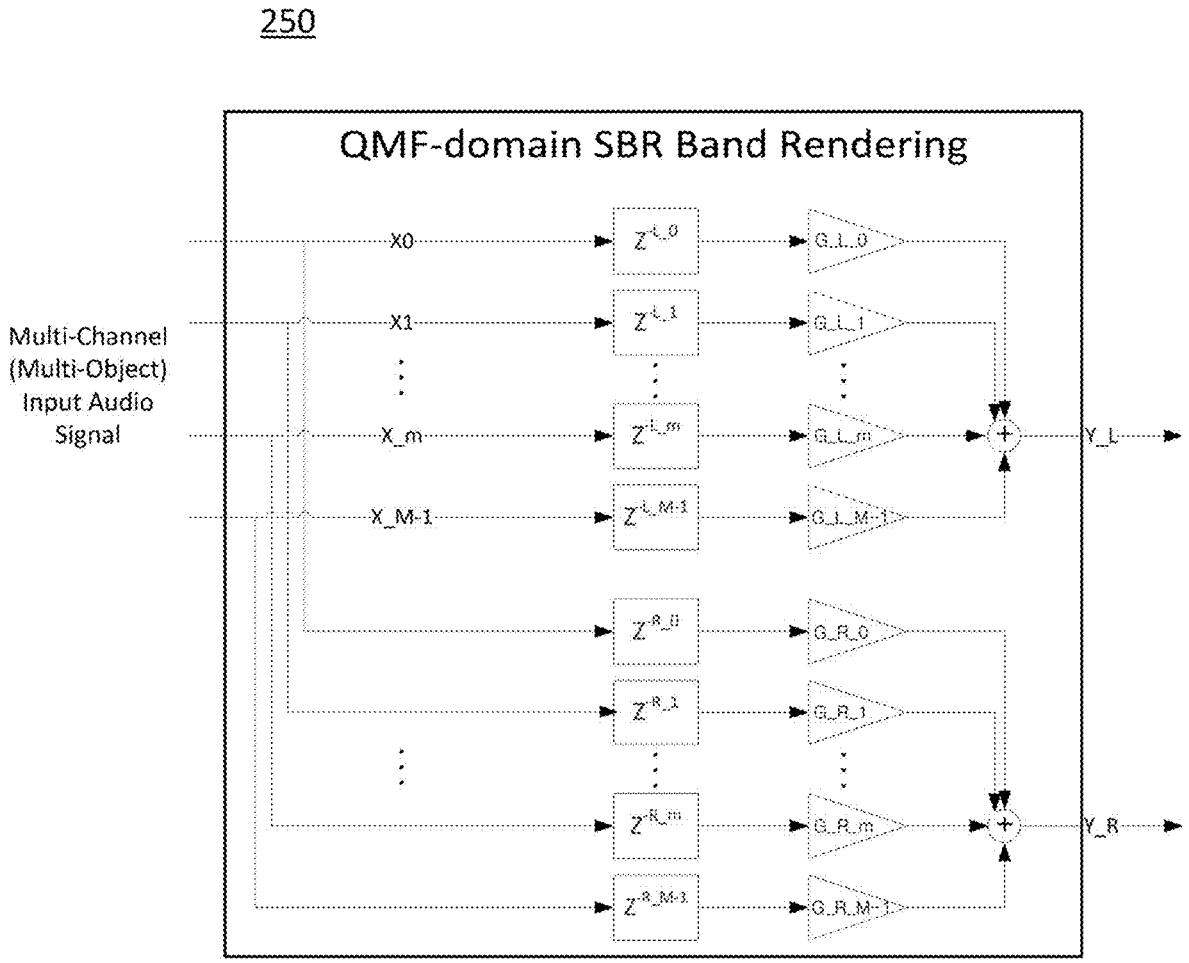
FIG. 9 is a diagram specifically illustrating QTDL processing according to an exemplary embodiment of the present invention.

FIG. 9 is a diagram more specifically illustrating QTDL processing according to the exemplary embodiment of the present invention. According to the exemplary embodiment of FIG. 9, the QTDL processing unit 250 performs subband-specific filtering of multi-channel input signals X0, X1, . . . , X_M-1 by using the one-tap-delay line filter. In this case, it is assumed that the multi-channel input signals are received as the subband signals of the QMF domain. Therefore, in the exemplary embodiment of FIG. 9, the one-tap-delay line filter may perform processing for each QMF subband. The one-tap-delay line filter performs the convolution of only one tap with respect to each channel signal. In this case, the used tap may be determined based on the parameter directly extracted from the BRIR subband filter coefficients corresponding to the relevant subband signal. The parameter includes delay information for the tap to be used in the one-tap-delay line filter and gain information corresponding thereto.

In FIG. 9, L_0, L_1, . . . . L_M-1 represent delays for the BRIRs with respect to M channels-left ear, respectively, and R_0, R_1, . . . , R_M-1 represent delays for the BRIRs with respect to M channels-right ear, respectively. In this case, the delay information represents positional information for the maximum peak in the order of an absolution value, the value of a real part, or the value of an imaginary part among the BRIR subband filter coefficients. Further, in FIG. 9, G_L_0, G_L_1, . . . , G_L_M-1 represent gains corresponding to respective delay information of the left channel and G_R_0, G_R_1, . . . , G_R_M-1 represent gains corresponding to the respective delay information of the right channels, respectively. Each gain information may be determined based on the total power of the corresponding BRIR subband filter coefficients, the size of the peak corresponding to the delay information, and the like. In this case, as the gain information, the weighted value of the corresponding peak after energy compensation for whole subband filter coefficients may be used as well as the corresponding peak value itself in the subband filter coefficients. The gain information is obtained by using both the real-number of the weighted value and the imaginary-number of the weighted value for the corresponding peak.

Meanwhile, the QTDL processing may be performed only with respect to input signals of high-frequency bands, which are classified based on the predetermined constant or the predetermined frequency band, as described above. When the spectral band replication (SBR) is applied to the input audio signal, the high-frequency bands may correspond to the SBR bands. The spectral band replication (SBR) used for efficient encoding of the high-frequency bands is a tool for securing a bandwidth as large as an original signal by re-extending a bandwidth which is narrowed by throwing out signals of the high-frequency bands in low-bit rate encoding. In this case, the high-frequency bands are generated by using information of low-frequency bands, which are encoded and transmitted, and additional information of the high-frequency band signals transmitted by the encoder. However, distortion may occur in a high-frequency component generated by using the SBR due to generation of inaccurate harmonics. Further, the SBR bands are the high-frequency bands, and as described above, reverberation times of the corresponding frequency bands are very short. That is, the BRIR subband filters of the SBR bands have small effective information and a high decay rate. Accordingly, in BRIR rendering for the high-frequency bands corresponding to the SBR bands, performing the rendering by using a small number of effective taps may be still more effective in terms of a computational complexity to the sound quality than performing the convolution.

The plurality of channel signals filtered by the one-tap-delay line filter is aggregated to the 2-channel left and right output signals Y_L and Y_R for each subband. Meanwhile, the parameter used in each one-tap-delay line filter of the QTDL processing unit 250 may be stored in the memory during an initialization process for the binaural rendering and the QTDL processing may be performed without an additional operation for extracting the parameter.

BRIR Parameterization in Detail

Figure 10:
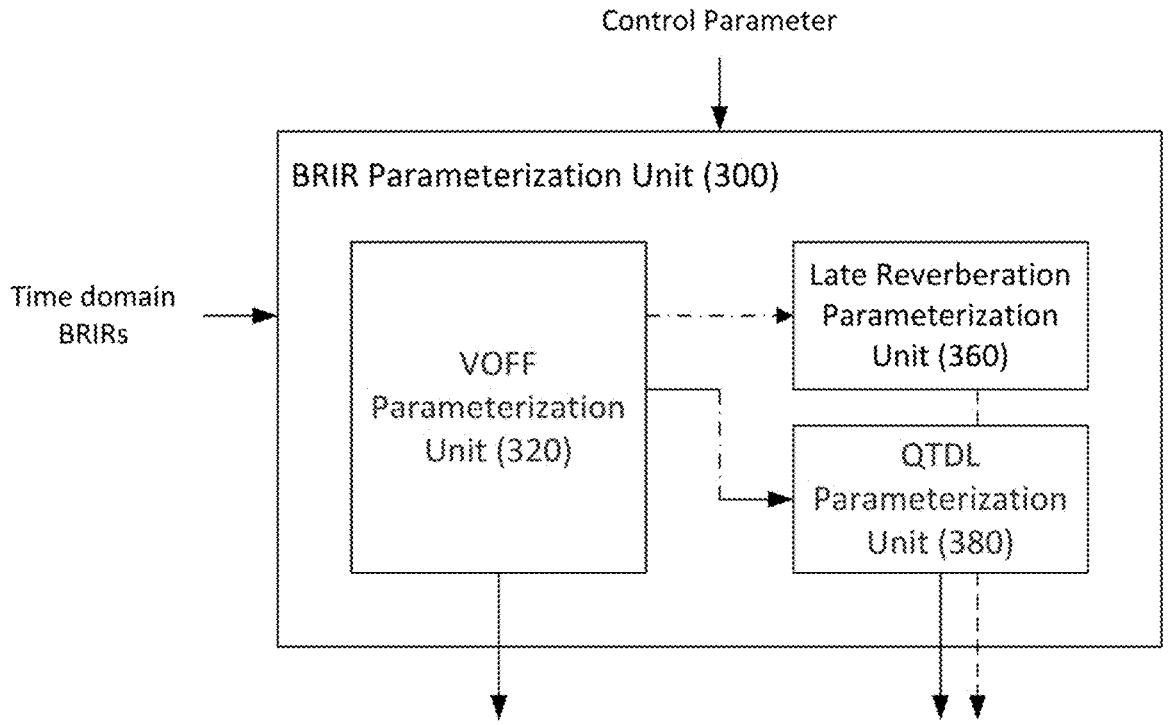
FIG. 10 is a block diagram illustrating respective components of a BRIR parameterization unit of the present invention.
Figure 14:
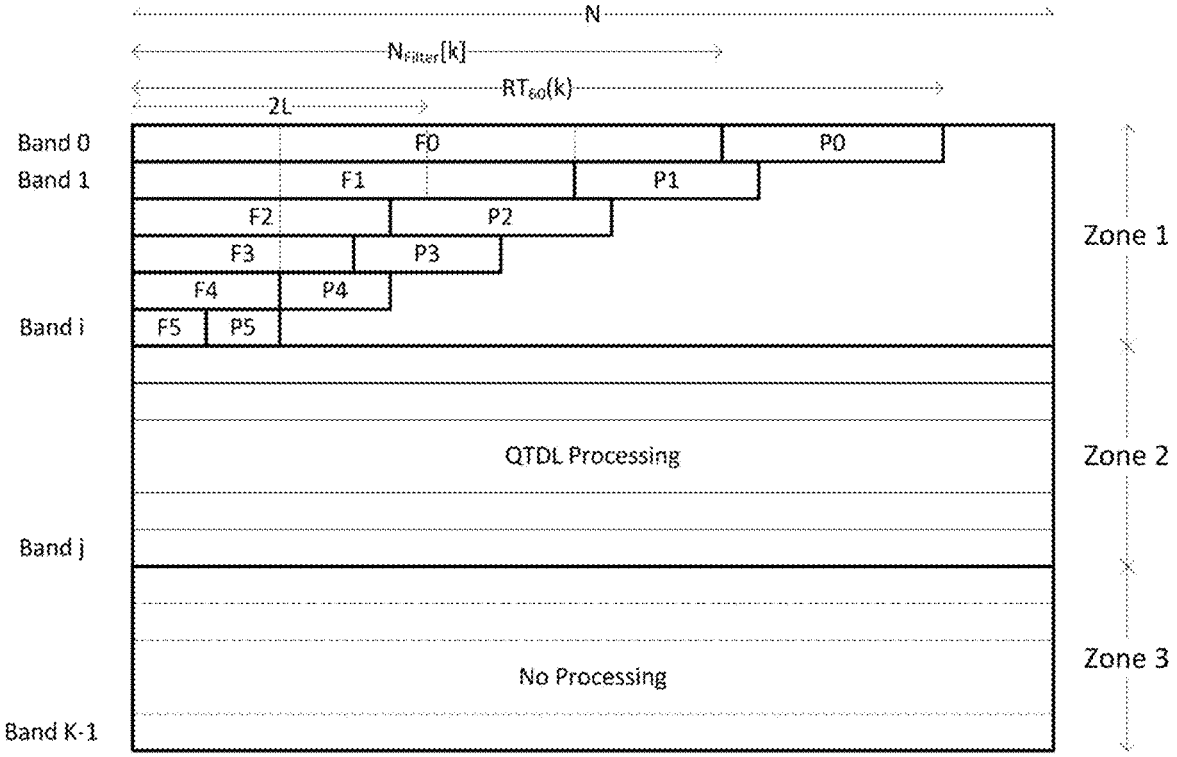
FIG. 14 is a diagram illustrating an exemplary embodiment of a method for generating FFT filter coefficients for block-wise fast convolution.

FIG. 10 is a block diagram illustrating respective components of a BRIR parameterization unit according to an exemplary embodiment of the present invention. As illustrated in FIG. 14, the BRIR parameterization unit 300 may include an VOFF parameterization unit 320, a late reverberation parameterization unit 360, and a QTDL parameterization unit 380. The BRIR parameterization unit 300 receives a BRIR filter set of the time domain as an input and each sub-unit of the BRIR parameterization unit 300 generate various parameters for the binaural rendering by using the received BRIR filter set. According to the exemplary embodiment, the BRIR parameterization unit 300 may additionally receive the control parameter and generate the parameter based on the receive control parameter.

First, the VOFF parameterization unit 320 generates truncated subband filter coefficients required for variable order filtering in frequency domain (VOFF) and the resulting auxiliary parameters. For example, the VOFF parameterization unit 320 calculates frequency band-specific reverberation time information, filter order information, and the like which are used for generating the truncated subband filter coefficients and determines the size of a block for performing block-wise fast Fourier transform for the truncated subband filter coefficients. Some parameters generated by the VOFF parameterization unit 320 may be transmitted to the late reverberation parameterization unit 360 and the QTDL parameterization unit 380. In this case, the transferred parameters are not limited to a final output value of the VOFF parameterization unit 320 and may include a parameter generated in the meantime according to processing of the VOFF parameterization unit 320, that is, the truncated BRIR filter coefficients of the time domain, and the like.

The late reverberation parameterization unit 360 generates a parameter required for late reverberation generation. For example, the late reverberation parameterization unit 360 may generate the downmix subband filter coefficients, the IC value, and the like. Further, the QTDL parameterization unit 380 generates a parameter for QTDL processing. In more detail, the QTDL parameterization unit 380 receives the subband filter coefficients from the late reverberation parameterization unit 320 and generates delay information and gain information in each subband by using the received subband filter coefficients. In this case, the QTDL parameterization unit 380 may receive information Kproc of a maximum frequency band for performing the binaural rendering and information Kconv of a frequency band for performing the convolution as the control parameters and generate the delay information and the gain information for each frequency band of a subband group having Kproc and Kconv as boundaries. According to the exemplary embodiment, the QTDL parameterization unit 380 may be provided as a component included in the VOFF parameterization unit 320.

The parameters generated in the VOFF parameterization unit 320, the late reverberation parameterization unit 360, and the QTDL parameterization unit 380, respectively are transmitted to the binaural rendering unit (not illustrated). According to the exemplary embodiment, the later reverberation parameterization unit 360 and the QTDL parameterization unit 380 may determine whether the parameters are generated according to whether the late reverberation processing and the QTDL processing are performed in the binaural rendering unit, respectively. When at least one of the late reverberation processing and the QTDL processing is not performed in the binaural rendering unit, the late reverberation parameterization unit 360 and the QTDL parameterization unit 380 corresponding thereto may not generate the parameters or not transmit the generated parameters to the binaural rendering unit.

Figure 11:
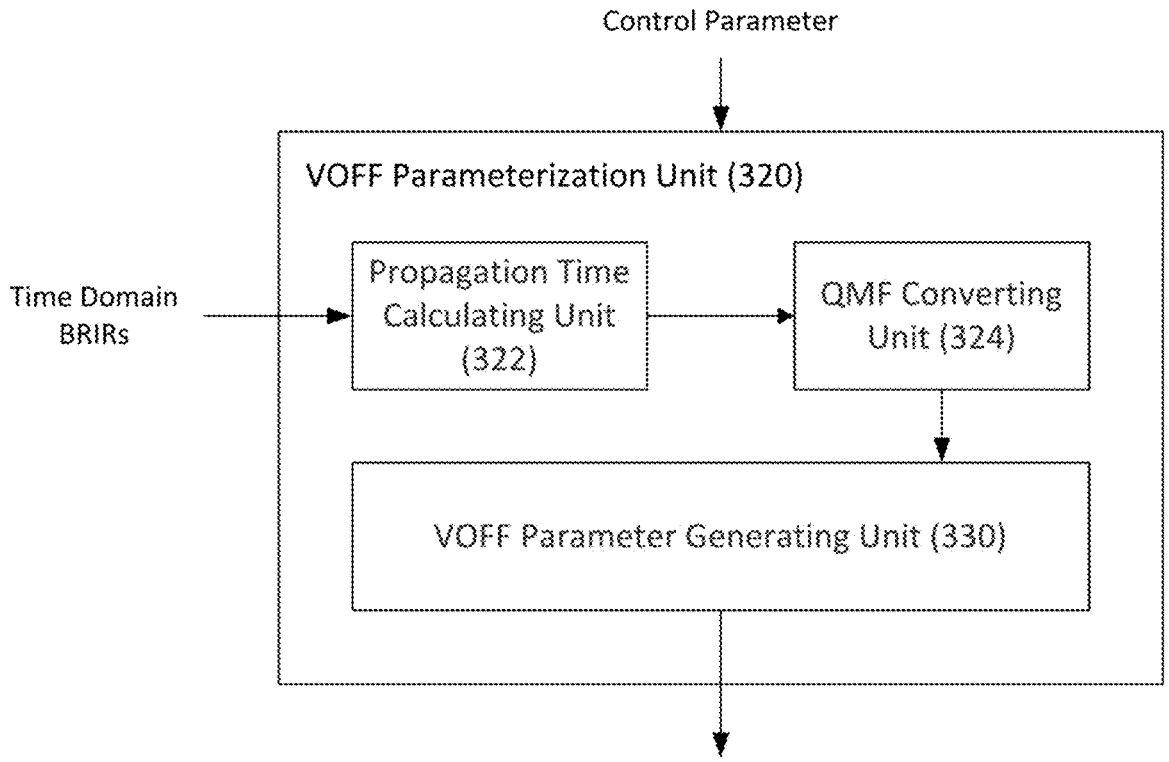
FIG. 11 is a block diagram illustrating respective components of a VOFF parameterization unit of the present invention.

FIG. 11 is a block diagram illustrating respective components of a VOFF parameterization unit of the present invention. As illustrated in FIG. 15, the VOFF parameterization unit 320 may include a propagation time calculating unit 322, a QMF converting unit 324, and an VOFF parameter generating unit 330. The VOFF parameterization unit 320 performs a process of generating the truncated subband filter coefficients for VOFF processing by using the received time domain BRIR filter coefficients.

First, the propagation time calculating unit 322 calculates propagation time information of the time domain BRIR filter coefficients and truncates the time domain BRIF filter coefficients based on the calculated propagation time information. Herein, the propagation time information represents a time from an initial sample to direct sound of the BRIR filter coefficients. The propagation time calculating unit 322 may truncate a part corresponding to the calculated propagation time from the time domain BRIR filter coefficients and remove the truncated part.

Various methods may be used for estimating the propagation time of the BRIR filter coefficients. According to the exemplary embodiment, the propagation time may be estimated based on first point information where an energy value larger than a threshold which is in proportion to a maximum peak value of the BRIR filter coefficients is shown. In this case, since all distances from respective channels of multi-channel inputs up to a listener are different from each other, the propagation time may vary for each channel. However, the truncating lengths of the propagation time of all channels need to be the same as each other in order to perform the convolution by using the BRIR filter coefficients in which the propagation time is truncated at the time of performing the binaural rendering and compensate a final signal in which the binaural rendering is performed with a delay. Further, when the truncating is performed by applying the same propagation time information to each channel, error occurrence probabilities in the individual channels may be reduced.

In order to calculate the propagation time information according to the exemplary embodiment of the present invention, frame energy E(k) for a frame wise index k may be first defined. When the time domain BRIR filter coefficient for an input channel index m, an output left/right channel index i, and a time slot index v of the time domain is $\tilde{h}_{i,m}^{v}$, the frame energy E(k) in a k-th frame may be calculated by an equation given below.

$$E(k) = \frac{1}{2N_{BRIR}} \sum_{m=1}^{N_{BRIR}} \sum_{i=0}^{1} \frac{1}{L_{frm}} \sum_{n=0}^{L_{frm}-1} \tilde{h}_{i,m}^{kN_{hop}+n} \quad \text{[Equation 2]}$$

Where, $N_{BRIR}$ represents the number of total filters of BRIR filter set, $N_{hop}$ represents a predetermined hop size, and $L_{frm}$ represents a frame size. That is, the frame energy E(k) may be calculated as an average value of the frame energy for each channel with respect to the same time interval.

The propagation time pt may be calculated through an equation given below by using the defined frame energy E(k).

$$pt = \frac{L_{frm}}{2} + N_{hop} \star \min\left[\arg_k\left(\frac{E(k)}{\max(E)} > -60 \text{ dB}\right)\right] \quad \text{[Equation 3]}$$

That is, the propagation time calculating unit 322 measures the frame energy by shifting a predetermined hop wise and identifies the first frame in which the frame energy is larger than a predetermined threshold. In this case, the propagation time may be determined as an intermediate point of the identified first frame. Meanwhile, in Equation 3, it is described that the threshold is set to a value which is lower than maximum frame energy by 60 dB, but the present invention is not limited thereto and the threshold may be set to a value which is in proportion to the maximum frame energy or a value which is different from the maximum frame energy by a predetermined value.

Meanwhile, the hop size $N_{hop}$ and the frame size $L_{frm}$ may vary based on whether the input BRIR filter coefficients are head related impulse response (HRIR) filter coefficients. In this case, information flag_HRIR indicating whether the input BRIR filter coefficients are the HRIR filter coefficients may be received from the outside or estimated by using the length of the time domain BRIR filter coefficients. In general, a boundary of an early reflection sound part and a late reverberation part is known as 80 ms. Therefore, when the length of the time domain BRIR filter coefficients is 80 ms or less, the corresponding BRIR filter coefficients are determined as the HRIR filter coefficients (flag_HRIR=1) and when the length of the time domain BRIR filter coefficients is more than 80 ms, it may be determined that the corresponding BRIR filter coefficients are not the HRIR filter coefficients (flag_HRIR=0). The hop size $N_{hop}$ and the frame size $L_{frm}$ when it is determined that the input BRIR filter coefficients are the HRIR filter coefficients (flag_HRIR=1) may be set to smaller values than those when it is determined that the corresponding BRIR filter coefficients are not the HRIR filter coefficients (flag_HRIR=0). For example, in the case of flag_HRIR=0, the hop size $N_{hop}$ and the frame size $L_{frm}$ may be set to 8 and 32 samples, respectively and in the case of flag_HRIR=1, the hop size $N_{hop}$ and the frame size $L_{frm}$ may be set to 1 and 8 sample(s), respectively.

According to the exemplary embodiment of the present invention, the propagation time calculating unit 322 may truncate the time domain BRIR filter coefficients based on the calculated propagation time information and transfer the truncated BRIR filter coefficients to the QMF converting unit 324. Herein, the truncated BRIR filter coefficients indicates remaining filter coefficients after truncating and removing the part corresponding to the propagation time from the original BRIR filter coefficients. The propagation time calculating unit 322 truncates the time domain BRIR filter coefficients for each input channel and each output left/right channel and transfers the truncated time domain BRIR filter coefficients to the QMF converting unit 324.

The QMF converting unit 324 performs conversion of the input BRIR filter coefficients between the time domain and the QMF domain. That is, the QMF converting unit 324 receives the truncated BRIR filter coefficients of the time domain and converts the received BRIR filter coefficients into a plurality of subband filter coefficients corresponding to a plurality of frequency bands, respectively. The converted subband filter coefficients are transferred to the VOFF parameter generating unit 330 and the VOFF parameter generating unit 330 generates the truncated subband filter coefficients by using the received subband filter coefficients. When the QMF domain BRIR filter coefficients instead of the time domain BRIR filter coefficients are received as the input of the VOFF parameterization unit 320, the received QMF domain BRIR filter coefficients may bypass the QMF converting unit 324. Further, according to another exemplary embodiment, when the input filter coefficients are the QMF domain BRIR filter coefficients, the QMF converting unit 324 may be omitted in the VOFF parameterization unit 320.

Figure 12:
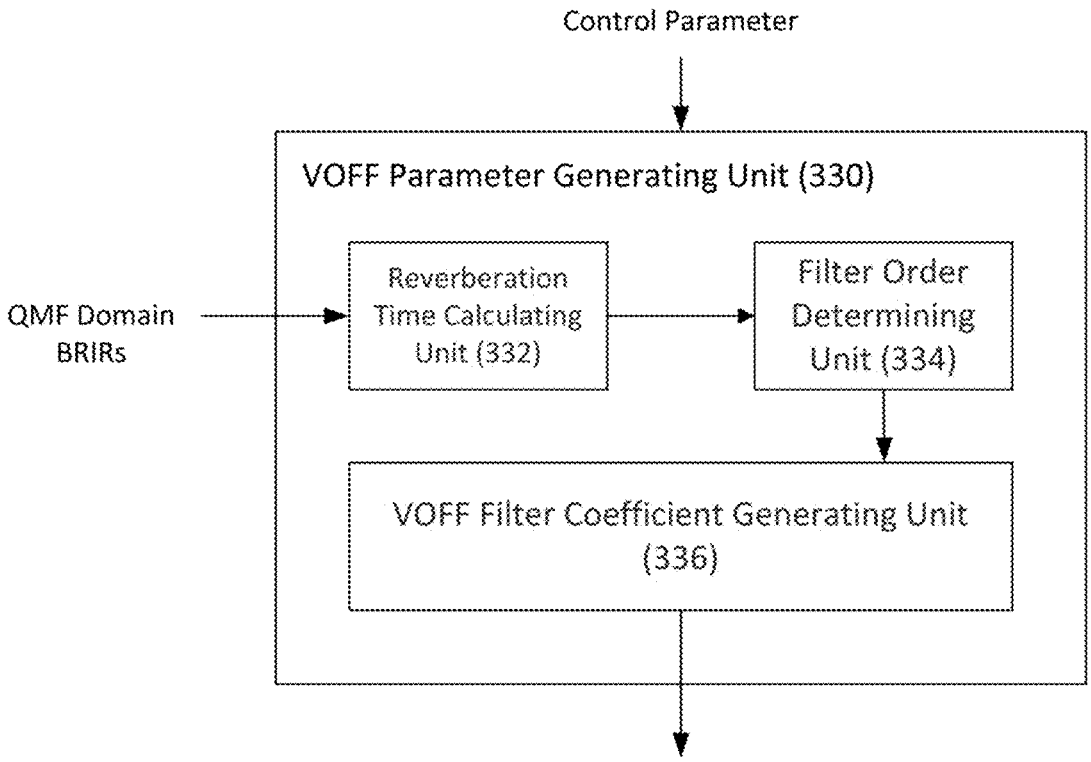
FIG. 12 is a block diagram illustrating a detailed configuration of a VOFF parameter generating unit of the present invention.

FIG. 12 is a block diagram illustrating a detailed configuration of the VOFF parameter generating unit of FIG. 11. As illustrated in FIG. 16, the VOFF parameter generating unit 330 may include a reverberation time calculating unit 332, a filter order determining unit 334, and a VOFF filter coefficient generating unit 336. The VOFF parameter generating unit 330 may receive the QMF domain subband filter coefficients from the QMF converting unit 324 of FIG. 11. Further, the control parameters including the maximum frequency band information Kproc performing the binaural rendering, the frequency band information Kconv performing the convolution, predetermined maximum FFT size information, and the like may be input into the VOFF parameter generating unit 330.

First, the reverberation time calculating unit 332 obtains the reverberation time information by using the received subband filter coefficients. The obtained reverberation time information may be transferred to the filter order determining unit 334 and used for determining the filter order of the corresponding subband. Meanwhile, since a bias or a deviation may be present in the reverberation time information according to a measurement environment, a unified value may be used by using a mutual relationship with another channel. According to the exemplary embodiment, the reverberation time calculating unit 332 generates average reverberation time information of each subband and transfers the generated average reverberation time information to the filter order determining unit 334. When the reverberation time information of the subband filter coefficients for the input channel index m, the output left/right channel index i, and the subband index k is RT(k, m, i), the average reverberation time information $RT^k$ of the subband k may be calculated through an equation given below.

$$RT^k = \frac{1}{2N_{BRIR}} \sum_{i=0}^{1} \sum_{m=0}^{N_{BRIR}-1} RT(k, m, i) \quad \text{[Equation 4]}$$

Where, $N_{BRIR}$ represents the number of total filters of BRIR filter set.

That is, the reverberation time calculating unit 332 extracts the reverberation time information RT(k, m, i) from each subband filter coefficients corresponding to the multichannel input and obtains an average value (that is, the average reverberation time information $RT^k$) of the reverberation time information RT(k, m, i) of each channel extracted with respect to the same subband. The obtained average reverberation time information $RT^k$ may be transferred to the filter order determining unit 334 and the filter order determining unit 334 may determine a single filter order applied to the corresponding subband by using the transferred average reverberation time information $RT^k$. In this case, the obtained average reverberation time information may include RT20 and according to the exemplary embodiment, other reverberation time information, that is to say, RT30, RT60, and the like may be obtained as well. Meanwhile, according to another exemplary embodiment of the present invention, the reverberation time calculating unit 332 may transfer a maximum value and/or a minimum value of the reverberation time information of each channel extracted with respect to the same subband to the filter order determining unit 334 as representative reverberation time information of the corresponding subband.

Next, the filter order determining unit 334 determines the filter order of the corresponding subband based on the obtained reverberation time information. As described above, the reverberation time information obtained by the filter order determining unit 334 may be the average reverberation time information of the corresponding subband and according to exemplary embodiment, the representative reverberation time information with the maximum value and/or the minimum value of the reverberation time information of each channel may be obtained instead. The filter order may be used for determining the length of the truncated subband filter coefficients for the binaural rendering of the corresponding subband.

When the average reverberation time information in the subband k is $RT^k$, the filter order information $N_{Filter}[k]$ of the corresponding subband may be obtained through an equation given below.

$$N_{Filter}[k] = 2^{\lfloor \log_2 RT^k + 0.5 \rfloor} \quad \text{[Equation 5]}$$

That is, the filter order information may be determined as a value of power of 2 using a log-scaled approximated integer value of the average reverberation time information of the corresponding subband as an index. In other words, the filter order information may be determined as a value of power of 2 using a round off value, a round up value, or a round down value of the average reverberation time information of the corresponding subband in the log scale as the index. When an original length of the corresponding subband filter coefficients, that is, a length up to the last time slot $n_{end}$ is smaller than the value determined in Equation 5, the filter order information may be substituted with the original length value $n_{end}$ of the subband filter coefficients. That is, the filter order information may be determined as a smaller value of a reference truncation length determined by Equation 5 and the original length of the subband filter coefficients.

Meanwhile, the decay of the energy depending on the frequency may be linearly approximated in the log scale. Therefore, when a curve fitting method is used, optimized filter order information of each subband may be determined. According to the exemplary embodiment of the present invention, the filter order determining unit 334 may obtain the filter order information by using a polynomial curve fitting method. To this end, the filter order determining unit 334 may obtain at least one coefficient for curve fitting of the average reverberation time information. For example, the filter order determining unit 334 performs curve fitting of the average reverberation time information for each subband by a linear equation in the log scale and obtain a slope value 'a' and a fragment value 'b' of the corresponding linear equation.

The curve-fitted filter order information $N'_{Filter}[k]$ in the subband k may be obtained through an equation given below by using the obtained coefficients.

$$N'_{Filter}[k] = 2^{\lfloor bk + a + 0.5 \rfloor} \quad \text{[Equation 6]}$$

That is, the curve-fitted filter order information may be determined as a value of power of 2 using an approximated integer value of a polynomial curve-fitted value of the average reverberation time information of the corresponding subband as the index. In other words, the curve-fitted filter order information may be determined as a value of power of 2 using a round off value, a round up value, or a round down value of the polynomial curve-fitted value of the average reverberation time information of the corresponding subband as the index. When the original length of the corresponding subband filter coefficients, that is, the length up to the last time slot $n_{end}$ is smaller than the value determined in Equation 6, the filter order information may be substituted with the original length value $n_{end}$ of the subband filter coefficients. That is, the filter order information may be determined as a smaller value of the reference truncation length determined by Equation 6 and the original length of the subband filter coefficients.

According to the exemplary embodiment of the present invention, based on whether proto-type BRIR filter coefficients, that is, the BRIR filter coefficients of the time domain are the HRIR filter coefficients (flag_HRIR), the filter order information may be obtained by using any one of Equation 5 and Equation 6. As described above, a value of flag_HRIR may be determined based on whether the length of the proto-type BRIR filter coefficients is more than a predetermined value. When the length of the proto-type BRIR filter coefficients is more than the predetermined value (that is, flag_HRIR=0), the filter order information may be determined as the curve-fitted value according to Equation 6 given above. However, when the length of the proto-type BRIR filter coefficients is not more than the predetermined value (that is, flag_HRIR=1), the filter order information may be determined as a non-curve-fitted value according to Equation 5 given above. That is, the filter order information may be determined based on the average reverberation time information of the corresponding subband without performing the curve fitting. The reason is that since the HRIR is not influenced by a room, a tendency of the energy decay is not apparent in the HRIR.

Meanwhile, according to the exemplary embodiment of the present invention, when the filter order information for a 0-th subband (that is, subband index 0) is obtained, the average reverberation time information in which the curve fitting is not performed may be used. The reason is that the reverberation time of the 0-th subband may have a different tendency from the reverberation time of another subband due to an influence of a room mode, and the like. Therefore, according to the exemplary embodiment of the present invention, the curve-fitted filter order information according to Equation 6 may be used only in the case of flag_HRIR=0 and in the subband in which the index is not 0.

The filter order information of each subband determined according to the exemplary embodiment given above is transferred to the VOFF filter coefficient generating unit 336. The VOFF filter coefficient generating unit 336 generates the truncated subband filter coefficients based on the obtained filter order information. According to the exemplary embodiment of the present invention, the truncated subband filter coefficients may be constituted by at least one FFT filter coefficient in which the fast Fourier transform (FFT) is performed by a predetermined block wise for block-wise fast convolution. The VOFF filter coefficient generating unit 336 may generate the FFT filter coefficients for the block-wise fast convolution as described below with reference to FIG. 14.

Figure 13:
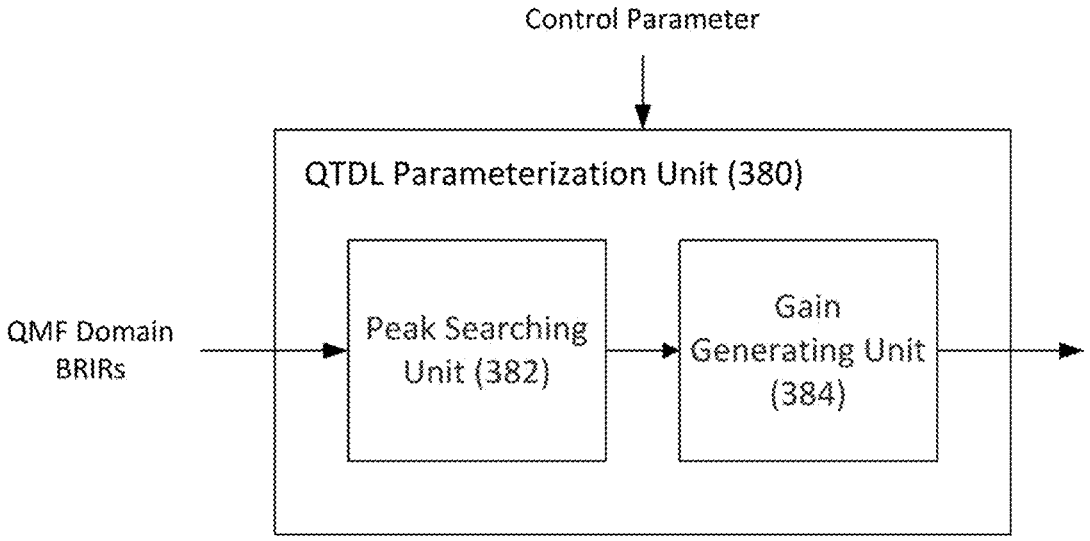
FIG. 13 is a block diagram illustrating respective components of a QTDL parameterization unit of the present invention.

FIG. 13 is a block diagram illustrating respective components of a QTDL parameterization unit of the present invention. As illustrated in FIG. 13, the QTDL parameterization unit 380 may include a peak searching unit 382 and a gain generating unit 384. The QTDL parameterization unit 380 may receive the QMF domain subband filter coefficients from the VOFF parameterization unit 320. Further, the QTDL parameterization unit 380 may receive the information Kproc of the maximum frequency band for performing the binaural rendering and information Kconv of the frequency band for performing the convolution as the control parameters and generate the delay information and the gain information for each frequency band of a subband group (that is, the second subband group) having Kproc and Kconv as boundaries.

According to a more detailed exemplary embodiment, when the BRIR subband filter coefficient for the input channel index m, the output left/right channel index i, the subband index k, and the QMF domain time slot index n is $h_{i,m}^{k}(n)$, the delay information $d_{i,m}^{k}$ and the gain information $g_{i,m}^{k}$ may be obtained as described below.

$$d_{i,m}^{k} = \underset{n}{\operatorname{argmax}}\left(|h_{i,m}^{k}(n)|^{2}\right) \quad \text{[Equation 7]}$$

$$g_{i,m}^{k} = \frac{\sqrt{\sum_{l=0}^{n_{end}} |h_{i,m}^{k}(l)|^{2}}}{|h_{i,m}^{k}(d_{i,m}^{k})|} h_{i,m}^{k}(d_{i,m}^{k}) \quad \text{[Equation 8]}$$

Where, $n_{end}$ represents the last time slot of the corresponding subband filter coefficients.

That is, referring to Equation 7, the delay information may represent information of a time slot where the corresponding BRIR subband filter coefficient has a maximum size and this represents positional information of a maximum peak of the corresponding BRIR subband filter coefficients. Further, referring to Equation 8, the gain information may be determined as a value obtained by multiplying the total power value of the corresponding BRIR subband filter coefficients by a sign of the BRIR subband filter coefficient at the maximum peak position.

The peak searching unit 382 obtains the maximum peak position that is, the delay information in each subband filter coefficients of the second subband group based on Equation 7. Further, the gain generating unit 384 obtains the gain information for each subband filter coefficients based on Equation 8. Equation 7 and Equation 8 show an example of equations obtaining the delay information and the gain information, but a detailed form of equations for calculating each information may be variously modified.

Block-Wise Fast Convolution

Meanwhile, according to the exemplary embodiments of the present invention, predetermined block-wise fast convolution may be performed for optimal binaural in terms of efficiency and performance. The FFT based fast convolution has a feature in that as the FFT size increases, the computational amount decreases, but the overall processing delay increases and a memory usage increases. When a BRIR having a length of 1 second is fast-convoluted to the FFT size having a length twice the corresponding length, it is efficient in terms of the computational amount, but a delay corresponding to 1 second occurs and a buffer and a processing memory corresponding thereto are required. An audio signal processing method having a long delay time is not suitable for an application for real-time data processing, and the like. Since a frame is a minimum unit by which decoding can be performed by the audio signal processing apparatus, the block-wise fast convolution is preferably performed with a size corresponding to the frame unit even in the binaural rendering.

FIG. 14 illustrates an exemplary embodiment of a method for generating FFT filter coefficients for block-wise fast convolution. Similarly to the aforementioned exemplary embodiment, in the exemplary embodiment of FIG. 14, the proto-type FIR filter is converted into K subband filters and Fk and Pk represent the truncated subband filter (front subband filter) and rear subband filter of the subband k, respectively. Each of the subbands Band 0 to Band K-1 may represent the subband in the frequency domain, that is, the QMF subband. In the QMF domain, a total of 64 subbands may be used, but the present invention is not limited thereto. Further, N represents the length (the number of taps) of the original subband filter and $N_{Filter}[k]$ represents the length of the front subband filter of subband k.

Like the aforementioned exemplary embodiment, a plurality of subbands of the QMF domain may be classified into a first subband group (Zone 1) having low frequencies and a second subband group (Zone 2) having high frequencies based on a predetermined frequency band (QMF band i). Alternatively, the plurality of subbands may be classified into three subband groups, that is, a first subband group (Zone 1), a second subband group (Zone 2), and a third subband group (Zone 3) based on a predetermined first frequency band (QMF band i) and a second frequency band (QMF band j). In this case, the VOFF processing using the block-wise fast convolution may be performed with respect to input subband signals of the first subband group and the QTDL processing may be performed with respect to the input subband signals of the second subband group, respectively. In addition, rendering may not be performed with respect to the subband signals of the third subband group. According to the exemplary embodiment, the late reverberation processing may be additionally performed with respect to the input subband signals of the first subband group.

Referring to FIG. 14, the VOFF filter coefficient generating unit 336 of the present invention performs fast Fourier transform of the truncated subband filter coefficients by a predetermined block size in the corresponding subband to generate FFT filter coefficients. In this case, the length $N_{FFT}[k]$ of the predetermined block in each subband k is determined based on a predetermined maximum FFT size 2 L. In more detail, the length $N_{FFT}[k]$ of the predetermined block in subband k may be expressed by the following equation.

$$N_{FFT}[k]=\min(2L, 2^{\lceil \log_2 2N_{Filter}[k] \rceil}) \quad \text{[Equation 9]}$$

Where, 2 L represents a predetermined maximum FFT size and $N_{Filter}[k]$ represents filter order information of subband k.

That is, the length $N_{FFT}[k]$ of the predetermined block may be determined as a smaller value between a value $2^{\lceil \log_2 2N_{Filter}[k] \rceil}$ twice a reference filter length of the truncated subband filter coefficients and the predetermined maximum FFT size 2 L. Herein, the reference filter length represents any one of a true value and an approximate value in a form of power of 2 of a filter order $N_{Filter}[k]$ (that is, the length of the truncated subband filter coefficients) in the corresponding subband k. That is, when the filter order of subband k has the form of power of 2, the corresponding filter order $N_{Filter}[k]$ is used as the reference filter length in subband k and when the filter order $N_{Filter}[k]$ of subband k does not have the form of power of 2 (e.g., $n_{end}$), a round off value, a round up value or a round down value in the form of power of 2 of the corresponding filter order $N_{Filter}[k]$ is used as the reference filter length. Meanwhile, according to the exemplary embodiment of the present invention, both the length $N_{FFT}[k]$ of the predetermined block and the reference filter length $2^{\lceil \log_2 N_{Filter}[k] \rceil}$ may be the power of 2 value.

When a value which is twice as large as the reference filter length is equal to or larger than (or larger than) a maximum FFT size 2 L like F0 and F1 of FIG. 14, each of predetermined block lengths $N_{FFT}[\mathbf{0}]$ and $N_{FFT}[\mathbf{1}]$ of the corresponding subbands is determined as the maximum FFT size 2 L. However, when the value which is twice as large as the reference filter length is smaller than (or equal to or smaller than) the maximum FFT size 2 L like F5 of FIG. 14, a predetermined block length $N_{FFT}[\mathbf{5}]$ of the corresponding subband is determined as $2^{\lceil \log_2 2N_{Filter}[5] \rceil}$ which is the value twice as large as the reference filter length. As described below, since the truncated subband filter coefficients are extended to a doubled length through the zero-padding and thereafter, fast-Fourier transformed, the length $N_{FFT}[k]$ of the block for the fast Fourier transform may be determined based on a comparison result between the value twice as large as the reference filter length and the predetermined maximum FFT size 2 L.

As described above, when the block length $N_{FFT}[k]$ in each subband is determined, the VOFF filter coefficient generating unit 336 performs the fast Fourier transform of the truncated subband filter coefficients by the determined block size. In more detail, the VOFF filter coefficient generating unit 336 partitions the truncated subband filter coefficients by the half $N_{FFT}[k]/2$ of the predetermined block size. An area of a dotted line boundary of the VOFF processing part illustrated in FIG. 14 represents the subband filter coefficients partitioned by the half of the predetermined block size. Next, the BRIR parameterization unit generates temporary filter coefficients of the predetermined block size $N_{FFT}[k]$ by using the respective partitioned filter coefficients. In this case, a first half part of the temporary filter coefficients is constituted by the partitioned filter coefficients and a second half part is constituted by zero-padded values. Therefore, the temporary filter coefficients of the length $N_{FFT}[k]$ of the predetermined block is generated by using the filter coefficients of the half length $N_{FFT}[k]/2$ of the predetermined block. Next, the BRIR parameterization unit performs the fast Fourier transform of the generated temporary filter coefficients to generate FFT filter coefficients. The generated FFT filter coefficients may be used for a predetermined block wise fast convolution for an input audio signal.

As described above, according to the exemplary embodiment of the present invention, the VOFF filter coefficient generating unit 336 performs the fast Fourier transform of the truncated subband filter coefficients by the block size determined independently for each subband to generate the FFT filter coefficients. As a result, a fast convolution using different numbers of blocks for each subband may be performed. In this case, the number $N_{blk}[k]$ of blocks in subband k may satisfy the following equation.

$$N_{blk}[k] = \frac{2^{\lceil \log_2 2N_{Filter}[k] \rceil}}{N_{FFT}[k]} \quad \text{[Equation 10]}$$

Where, $N_{blk}[k]$ is a natural number.

That is, the number $N_{blk}[k]$ of blocks in subband k may be determined as a value acquired by dividing the value twice the reference filter length in the corresponding subband by the length $N_{FFT}[k]$ of the predetermined block.

Meanwhile, according to the exemplary embodiment of the present invention, the generating process of the predetermined block-wise FFT filter coefficients may be restrictively performed with respect to the front subband filter Fk of the first subband group. Meanwhile, according to the exemplary embodiment, the late reverberation processing for the subband signal of the first subband group may be performed by the late reverberation generating unit as described above. According to the exemplary embodiment of the present invention, the late reverberation processing for an input audio signal may be performed based on whether the length of the proto-type BRIR filter coefficients is more than the predetermined value. As described above, whether the length of the proto-type BRIR filter coefficients is more than the predetermined value may be represented through a flag (that is, flag_BRIR) indicating that the length of the proto-type BRIR filter coefficients is more than the predetermined value. When the length of the proto-type BRIR filter coefficients is more than the predetermined value (flag_HRIR=0), the late reverberation processing for the input audio signal may be performed. However, when the length of the proto-type BRIR filter coefficients is not more than the predetermined value (flag_HRIR=1), the late reverberation processing for the input audio signal may not be performed.

When late reverberation processing is not be performed, only the VOFF processing for each subband signal of the first subband group may be performed. However, a filter order (that is, a truncation point) of each subband designated for the VOFF processing may be smaller than a total length of the corresponding subband filter coefficients, and as a result, energy mismatch may occur. Therefore, in order to prevent the energy mismatch, according to the exemplary embodiment of the present invention, energy compensation for the truncated subband filter coefficients may be performed based on flag_HRIR information. That is, when the length of the proto-type BRIR filter coefficients is not more than the predetermined value (flag_HRIR=1), the filter coefficients of which the energy compensation is performed may be used as the truncated subband filter coefficients or each FFT filter coefficients constituting the same. In this case, the energy compensation may be performed by dividing the subband filter coefficients up to the truncation point based on the filter order information $N_{Filter}[k]$ by filter power up to the truncation point, and multiplying total filter power of the corresponding subband filter coefficients. The total filter power may be defined as the sum of the power for the filter coefficients from the initial sample up to the last sample $n_{end}$ of the corresponding subband filter coefficients.

Meanwhile, according to another exemplary embodiment of the present invention, the filter orders of the respective subband filter coefficients may be set different from each other for each channel. For example, the filter order for front channels in which the input signals include more energy may be set to be higher than the filter order for rear channels in which the input signals include relatively smaller energy. Therefore, a resolution reflected after the binaural rendering is increased with respect to the front channels and the rendering may be performed with a low computational complexity with respect to the rear channels. Herein, classification of the front channels and the rear channels is not limited to channel names allocated to each channel of the multi-channel input signal and the respective channels may be classified into the front channels and the rear channels based on a predetermined spatial reference. Further, according to an additional exemplary embodiment of the present invention, the respective channels of the multi-channels may be classified into three or more channel groups based on the predetermined spatial reference and different filter orders may be used for each channel group. Alternatively, values to which different weighted values are applied based on positional information of the corresponding channel in a virtual reproduction space may be used for the filter orders of the subband filter coefficients corresponding to the respective channels.

Hereinabove, the present invention has been descried through the detailed exemplary embodiments, but modification and changes of the present invention can be made by those skilled in the art without departing from the object and the scope of the present invention. That is, the exemplary embodiment of the binaural rendering for the multi-audio signals has been described in the present invention, but the present invention can be similarly applied and extended to even various multimedia signals including a video signal as well as the audio signal. Accordingly, it is analyzed that matters which can easily be analogized by those skilled in the art from the detailed description and the exemplary embodiment of the present invention are included in the claims of the present invention.

MODE FOR INVENTION

As above, related features have been described in the best mode.

INDUSTRIAL APPLICABILITY

The present invention can be applied to various forms of apparatuses for processing a multimedia signal including an apparatus for processing an audio signal and an apparatus for processing a video signal, and the like.

Furthermore, the present invention can be applied to a parameterization device for generating parameters used for the audio signal processing and the video signal processing.

What is claimed is:

1. A method for processing an audio signal, the method comprising:

receiving an input audio signal;

receiving a set of truncated subband filter coefficients for each subband and each channel, wherein the set of truncated subband filter coefficients is truncated frequency dependently from a set of subband filter coefficients of a binaural room impulse response (BRIR) data set, wherein the length of the set of truncated subband filter coefficients is determined based on a filter order of the corresponding subband, and wherein the filter order is determined to be variable in the frequency domain;

obtaining vector information indicating a particular BRIR data set corresponding to a relevant channel of the input audio signal; and filtering each subband signal of the input audio signal by using the set of truncated subband filter coefficients corresponding to the relevant channel and a relevant subband based on the vector information.

2. The method of claim 1, wherein when a first BRIR data set having positional information matching with positional information of the relevant channel of the input audio signal is present in a predetermined BRIR filter set, the vector information indicates the first BRIR data set as the particular BRIR data set corresponding to the relevant channel.

3. The method of claim 1, wherein when a first BRIR data set having positional information matching with positional information of the relevant channel of the input audio signal is not present in a predetermined BRIR filter set, the vector information indicates a second BRIR data set having a minimum geometric distance from the positional information of the relevant channel as the particular BRIR data set corresponding to the relevant channel.

4. The method of claim 3, wherein the geometric distance is a value obtained by aggregating an absolute value of an altitude deviation between two positions and an absolute value of an azimuth deviation between the two positions.

5. The method of claim 1, wherein a length of the set of truncated subband filter coefficients of at least one subband is different from a length of the set of truncated subband filter coefficients of another subband.

6. An apparatus for processing an audio signal for performing binaural rendering for an input audio signal, the apparatus comprising:

a binaural rendering unit configured to:

receive an input audio signal, receive a set of truncated subband filter coefficients for each subband and each channel, wherein the set of truncated subband filter coefficients is truncated frequency dependently from a set of subband filter coefficients of a binaural room impulse response (BRIR) data set, wherein the length of the set of truncated subband filter coefficients is determined based on a filter order of the corresponding subband, and wherein the filter order is determined to be variable in the frequency domain, obtain vector information indicating a particular BRIR data set corresponding to a relevant channel of the input audio signal, and filter each subband signal of the multi-channel signal by using the truncated subband filter coefficients corresponding to the relevant channel and a relevant subband based on the vector information.

7. The apparatus of claim 6, wherein when a first BRIR data set having positional information matching with positional information of the relevant channel of the input audio signal is present in a predetermined BRIR filter set, the vector information indicates the first BRIR data set as the particular BRIR data set corresponding to the relevant channel.

8. The apparatus of claim 6, wherein when a first BRIR data set having positional information matching with positional information of the relevant channel of the input audio signal is not present in a predetermined BRIR filter set, the vector information indicates a second BRIR data set having a minimum geometric distance from the positional information of the relevant channel as the particular BRIR data set corresponding to the relevant channel.

9. The apparatus of claim 8, wherein the geometric distance is a value obtained by aggregating an absolute value of an altitude deviation between two positions and an absolute value of an azimuth deviation between the two positions.

10. The apparatus of claim 6, wherein a length of the set of truncated subband filter coefficients of at least one subband is different from a length of the set of truncated subband filter coefficients of another subband.

* * * * *